US012492602B2

(12) United States Patent
Kruse et al.

(10) Patent No.: US 12,492,602 B2
(45) Date of Patent: Dec. 9, 2025

(54) DEVICES, SYSTEMS, AND METHODS FOR RETRIEVING INNER TUBES

(71) Applicant: BOART LONGYEAR MANUFACTURING AND DISTRIBUTION INC., Salt Lake City, UT (US)

(72) Inventors: Christof Kruse, Wenden (DE); Thorsten Upmeier, Schlitz (DE); Shuan Niel Prince, Olpe (DE)

(73) Assignee: Boart Longyear Manufacturing And Distribution Inc., Salt Lake City, UT (US)

( * ) Notice: Subject to any disclaimer, the term of this patent is extended or adjusted under 35 U.S.C. 154(b) by 0 days.

(21) Appl. No.: 18/276,830

(22) PCT Filed: Mar. 8, 2022

(86) PCT No.: PCT/US2022/019259

§ 371 (c)(1),
(2) Date: Aug. 10, 2023

(87) PCT Pub. No.: WO2022/192192

PCT Pub. Date: Sep. 15, 2022

(65) Prior Publication Data

US 2024/0318521 A1 Sep. 26, 2024

Related U.S. Application Data

(60) Provisional application No. 63/159,241, filed on Mar. 10, 2021.

(51) Int. Cl.
*E21B 25/02* (2006.01)
*E21B 3/02* (2006.01)
(Continued)

(52) U.S. Cl.
CPC ..... *E21B 25/02* (2013.01); *E21B 3/022* (2020.05); *E21B 7/023* (2013.01); *E21B 15/00* (2013.01); *E21B 19/008* (2013.01); *E21B 19/084* (2013.01)

(58) Field of Classification Search
CPC ..... E21B 25/02; E21B 3/022; E21B 19/008; E21B 7/023; E21B 15/00; E21B 19/084
See application file for complete search history.

(56) References Cited

U.S. PATENT DOCUMENTS 3,835,940 A 9/1974 Winter
4,262,754 A * 4/1981 Nelson ..... E21B 3/022 292/201

(Continued)

*Primary Examiner* — Nicole Coy
*Assistant Examiner* — Jennifer A Railey
(74) *Attorney, Agent, or Firm* — Ballard Spahr LLP

(57) ABSTRACT

Devices, systems, and methods for retrieving inner tubes following core sampling are disclosed. Exemplary systems include a drill rig having a drilling axis. The drill rig can have a mast having a longitudinal axis and opposed first and second ends, the first end of the mast being configured for positioning proximate a drilling formation. A drill head can be configured to impart rotation to a drill string. The drill head can be configured for movement about and between a first position in which the drilling axis extends through the drill head; and a second position in which drill head is spaced from the drilling axis.

18 Claims, 18 Drawing Sheets

(51) Int. Cl.

| | |
|---|---|
| ***E21B 7/02*** | (2006.01) |
| ***E21B 15/00*** | (2006.01) |
| ***E21B 19/00*** | (2006.01) |
| ***E21B 19/084*** | (2006.01) |

(56) References Cited

U.S. PATENT DOCUMENTS

| | | | | |
|---|---|---|---|---|
| 2016/0298441 | A1* | 10/2016 | Orban | E21B 33/072 |
| 2017/0081144 | A1* | 3/2017 | Upmeier | E21B 7/02 |
| 2018/0245408 | A1* | 8/2018 | Keogh | B25J 9/1065 |
| 2020/0224526 | A1* | 7/2020 | Parmeshwar | E21B 47/024 |
| 2020/0270968 | A1* | 8/2020 | Schloegel | F16G 13/16 |

* cited by examiner

DEVICES, SYSTEMS, AND METHODS FOR RETRIEVING INNER TUBES

CROSS-REFERENCE TO RELATED APPLICATION

This application is a national phase filing under 35 U.S.C. § 371 of International Application No. PCT/US2022/019259, filed Mar. 8, 2022, which claims priority to and the benefit of U.S. Provisional Application No. 63/159,241, filed Mar. 10, 2021, which applications are incorporated herein by reference in their entirety.

FIELD

This application relates to devices, systems, and methods for retrieving inner tubes following core sampling. In exemplary aspects, this application relates to drill rigs that permit retrieval of core barrels (inner tubes) of varying lengths.

BACKGROUND

Exploration with drill rigs (e.g., diamond coring drill rigs) commonly includes the use of wireline assemblies to pull, from a borehole, an inner tube assembly with a core sample therein. The drill rig can comprise a foot clamp and a drill head on a drill mast. The drill head can be raised to the top of the mast, and a roller subassembly of the wireline assembly can swivel into position below the drill head in order to pull the inner tube assembly from the borehole. However, as can be understood, the height of drill head in the raised position at the top of the mast can set a limit as to the maximum length for pulling the core sample. That is, the length between the foot clamp and the roller assembly (which is beneath the drill head) can be the maximum length of an inner tube assembly that the drill rig can accommodate during retrieval. Accordingly, the maximum length of the core sample that can be retrieved is limited. Thus, many short core samples have to be drilled and retrieved in order to obtain samples across a given sampling length. The core retrieval process can be slow, so reducing the number of retrieved core samples can reduce the overall time of operation. Accordingly, a system for collecting fewer, longer core samples across the given sampling length is desirable.

SUMMARY

Described herein, in various aspects, is a drill rig for retrieving inner tube assemblies. In one aspect, the drill rig can have a drilling axis. The drill rig can comprise a mast having a longitudinal axis and opposed first and second ends, the first end of the mast being configured for positioning proximate a drilling formation. A drill head can be configured to impart rotation to a drill string. The drill head can be configured for movement about and between a first position in which the drilling axis extends through the drill head; and a second position in which drill head is spaced from the drilling axis.

Additional advantages of the disclosed apparatuses, systems, and methods will be set forth in part in the description that follows, and in part will be obvious from the description, or may be learned by practice of the invention. The advantages of the disclosed apparatuses, systems, and methods will be realized and attained by means of the elements and combinations particularly pointed out in the appended claims. It is to be understood that both the foregoing general description and the following detailed description are exemplary and explanatory only and are not restrictive of the invention, as claimed.

DESCRIPTION OF THE DRAWINGS

These and other features of the preferred embodiments of the disclosed apparatuses, systems, and methods will become more apparent in the detailed description in which reference is made to the appended drawings wherein:

FIGS. 20B-20D are various perspective views of portions of the roller assembly of FIG. 20A. FIG. 20B is an end view of the roller assembly of FIG. 20A. FIG. 20C is an isolated perspective view of a drilling cable positioned within a groove defined by a sheave of the roller assembly, as disclosed herein. FIG. 20D is an isolated cross-sectional view of bearings that surround a connector of the roller assembly, as disclosed herein.

DETAILED DESCRIPTION

Figure 1:
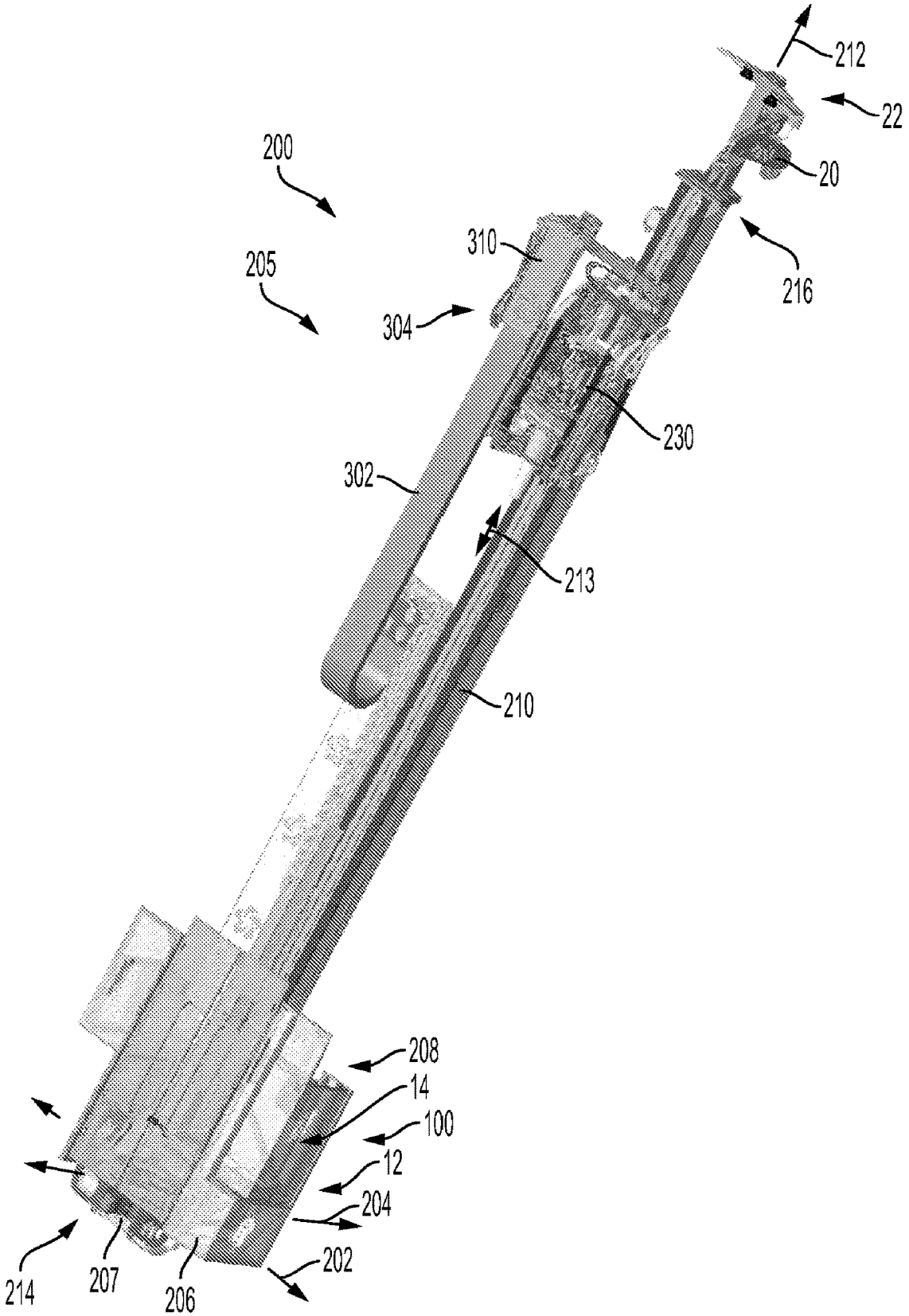
FIG. 1 is a front perspective view of a drill rig in accordance with embodiments disclosed herein, wherein the drill rig has a drill head in a first position.

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout. It is to be understood that this invention is not limited to the particular methodology and protocols described, as such may vary. It is also to be understood that the terminology used herein is for the purpose of describing particular embodiments only, and is not intended to limit the scope of the present invention.

Many modifications and other embodiments of the invention set forth herein will come to mind to one skilled in the art to which the invention pertains having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

As used herein the singular forms "a," "an," and "the" include plural referents unless the context clearly dictates otherwise. For example, use of the term "a sensor" can refer to one or more of such sensors, and so forth.

All technical and scientific terms used herein have the same meaning as commonly understood to one of ordinary skill in the art to which this invention belongs unless clearly indicated otherwise.

As used herein, the terms "optional" or "optionally" mean that the subsequently described event or circumstance may or may not occur, and that the description includes instances where said event or circumstance occurs and instances where it does not.

As used herein, the term "at least one of" is intended to be synonymous with "one or more of." For example, "at least one of A, B and C" explicitly includes only A, only B, only C, and combinations of each.

Ranges can be expressed herein as from "about" or "approximately" one particular value, and/or to "about" or "approximately" another particular value. When such a range is expressed, another aspect includes from the one particular value and/or to the other particular value. Similarly, when values are expressed as approximations, by use of the antecedent "about" or "approximately," it will be understood that the particular value forms another aspect. It will be further understood that the endpoints of each of the ranges are significant both in relation to the other endpoint, and independently of the other endpoint. Optionally, in some aspects, when values are approximated by use of the antecedent "about," "approximately," "substantially," or "generally," it is contemplated that values within up to 15%, up to 10%, up to 5%, or up to 1% (above or below) of the particularly stated value can be included within the scope of those aspects. In further optional aspects, when angular values are approximated by use of the antecedent "about," "approximately," "substantially," or "generally," it is contemplated that values within up to 15 degrees, up to 10 degrees, up to 5 degrees, or up to 1 degree (above or below) of the particularly stated value can be included within the scope of those aspects.

The word "or" as used herein can mean any one member of a particular list and, except where the context indicates otherwise, can also include any combination of members of that list.

It is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that an order be inferred, in any respect. This holds for any possible non-express basis for interpretation, including: matters of logic with respect to arrangement of steps or operational flow; plain meaning derived from grammatical organization or punctuation; and the number or type of aspects described in the specification.

The following description supplies specific details in order to provide a thorough understanding. Nevertheless, the skilled artisan would understand that the apparatus, system, and associated methods of using the apparatus can be implemented and used without employing these specific details. Indeed, the apparatus, system, and associated methods can be placed into practice by modifying the illustrated apparatus, system, and associated methods and can be used in conjunction with any other apparatus and techniques conventionally used in the industry.

Figure 2:
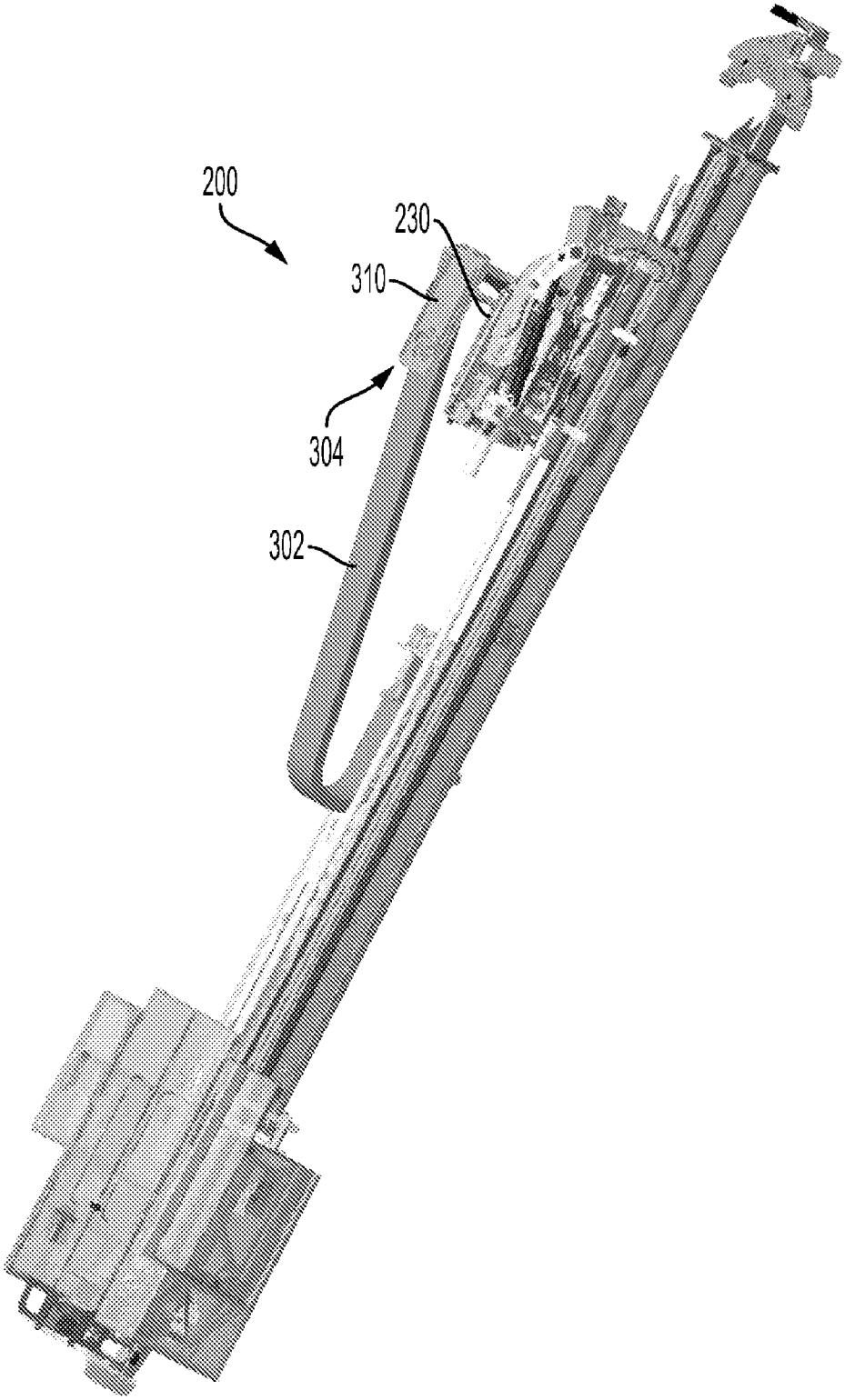
FIG. 2 is a front perspective view of the drill rig of FIG. 1 with the drill head in a second position.
Figure 3:
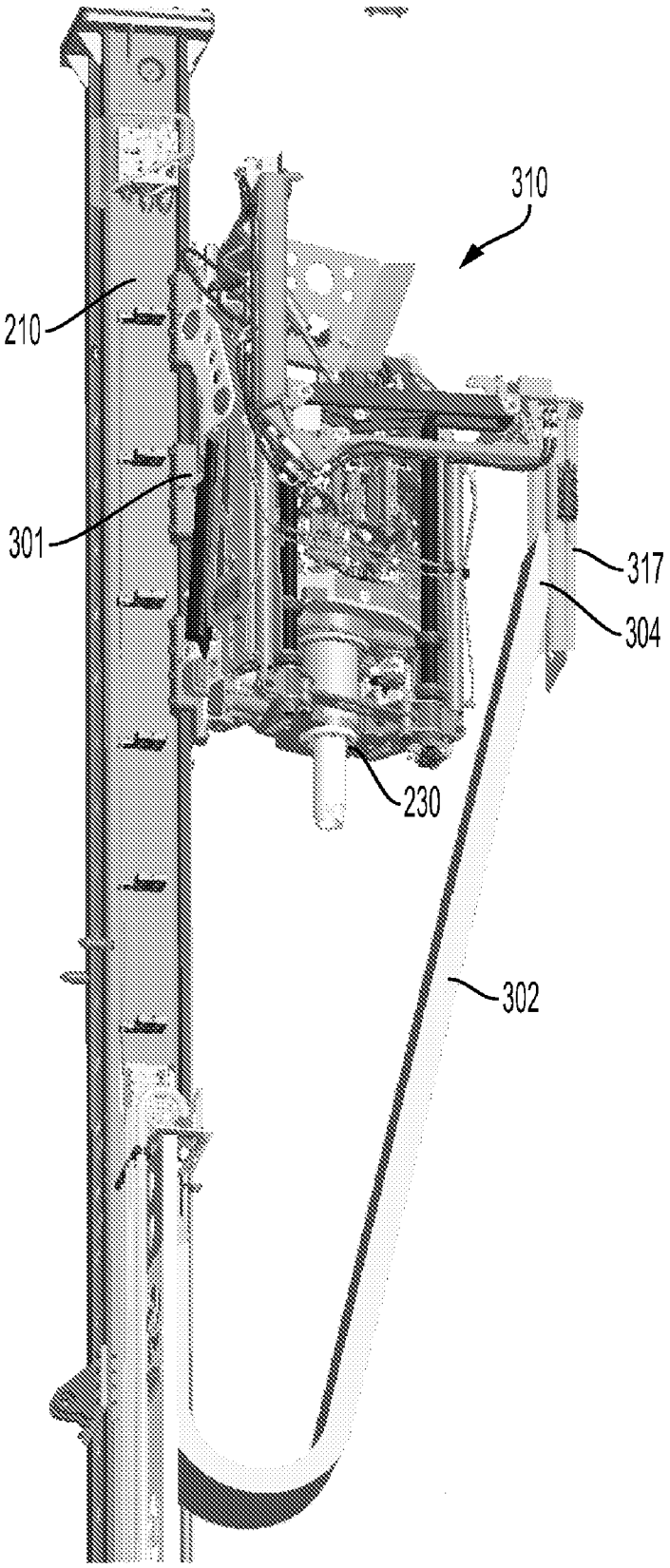
FIG. 3 is a partial side perspective of the drill rig of FIG. 2.

Disclosed herein, with reference to FIGS. 1-3, is a system comprising a wireline system 100 and a drill rig 200. The drill rig 200 can comprise a drilling system 205, which can comprise a mast 210, a drill string (not shown), and a drill head 230 configured to impart rotation to the drill string within a drilling formation. The mast 210 can have a longitudinal axis 212 and opposed first and second ends 214, 216, with the first end of the mast being configured for positioning proximate the drilling formation. The drill head 230 can optionally be configured for selective movement along the longitudinal axis 212 of the mast 210. The drill rig 200 can have a first transverse axis 202 and a second transverse axis 204 extending perpendicularly relative to first transverse axis. When the mast 210 is positioned in a vertical position, as shown in FIG. 2, it is contemplated that the first and second transverse axes 202, 204 can be perpendicular or substantially perpendicular to the longitudinal axis 212 of the mast. The first transverse axis 202 divides the drill rig 200 into a front portion 206 and a back portion 208, and the second transverse axis 204 extends from the front portion of the drill rig to the back portion of the drill rig. In exemplary aspects, the wireline system 100 can comprise a wireline assembly 10 and a roller assembly 20.

In operation, the drilling system 205 can rotate and feed the drill string into the drilling formation along a drilling axis 213 that can be parallel to the longitudinal axis 212. The drilling system 205 can further comprise a foot clamp 207 as is conventionally known in the art. Optionally, the foot clamp 207 can be provided in association with a breaker and/or wrench. In exemplary aspects, the drilling system 205 can comprise a control panel positioned in the front portion 206 of the drill rig 200, from which drilling functions are controlled. As further disclosed herein, the rotary drill head 230, the foot clamp 207 and other moving parts of the drilling system 205 can be secured within a safety cage 150 during drilling. It is contemplated that the drilling system 205 can optionally switch into lower power (rpm, rotation, feed) settings during changing of a drill rod, when at least one door 152 of the safety cage 150 is open. During exploratory drilling operations, the wireline system 100 disclosed herein can be configured to selectively lower and lift up a core barrel (inner tube assembly 16) relative to the drilling formation using a cable 140. As is conventional in the art, the core barrel (inner tube assembly) can collect a core sample of the drilling formation for geological analysis. In exemplary aspects, the roller assembly 20 can be operatively associated with the wireline assembly 10 and, optionally, can be crown block mounted on an upper portion of the mast 210. As further disclosed herein, the wireline system 100 can generally be positioned within the front portion 206 of the drill rig 200, thereby improving the visibility of the wireline system from the perspective of a drill operator positioned proximate the control panel. During deep drilling operations, it is contemplated that the wireline system 100 can be configured to run at a high speed and in a precise manner.

Figure 19A:
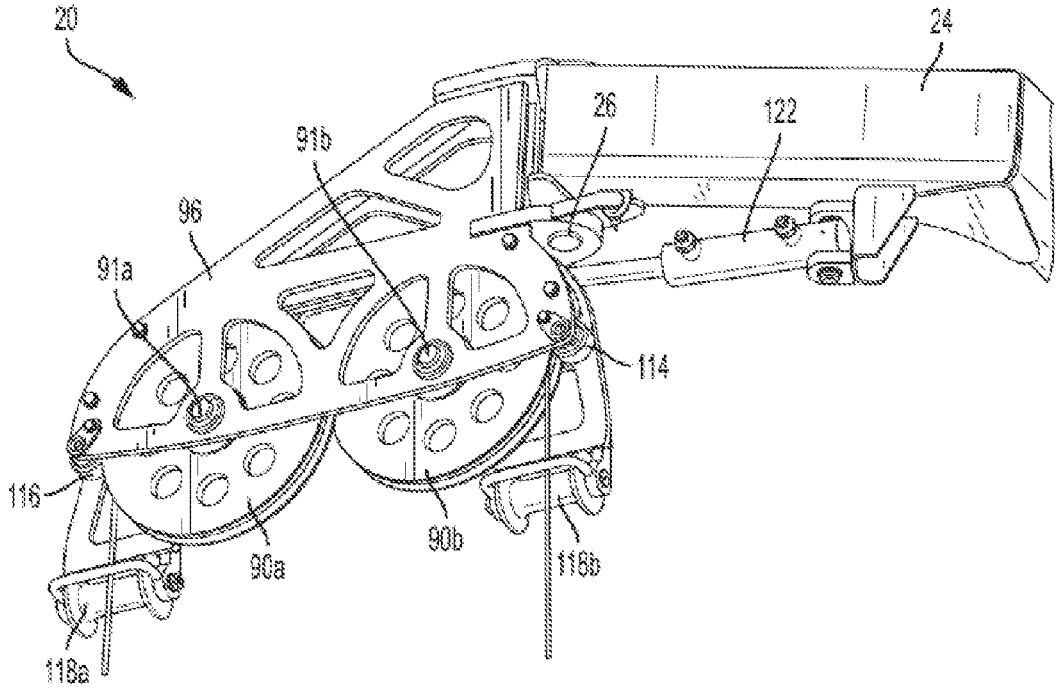
FIGS. 19A-19B provide various perspective views of an exemplary roller assembly as disclosed herein.
Figure 19B:
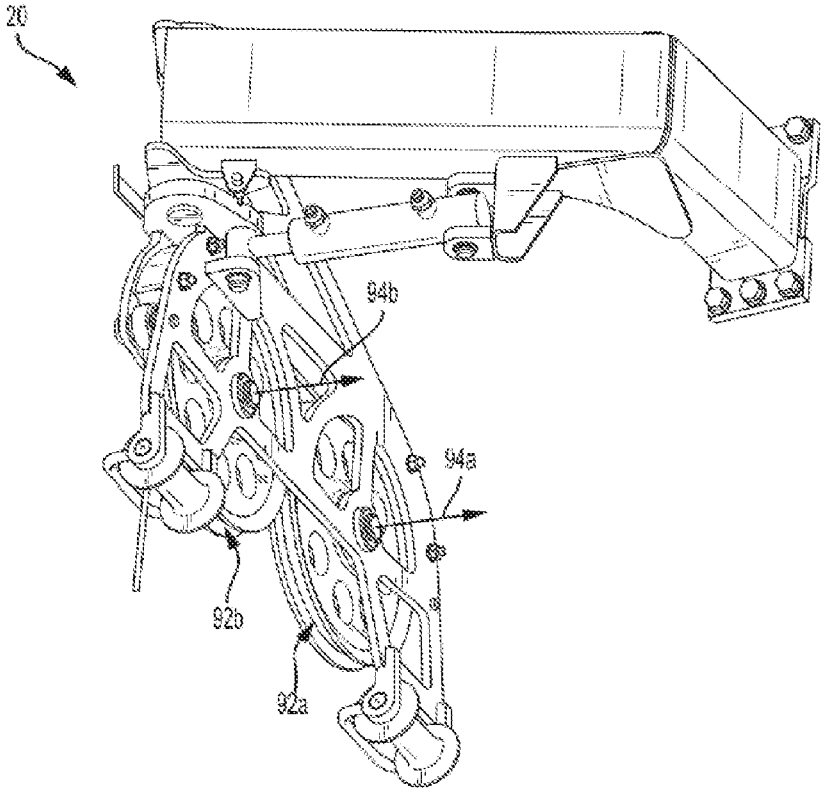

In one aspect, the wireline assembly 10 of the wireline system 100 can be operatively secured to the mast 210 at a first axial location 12 along the longitudinal axis 212 of the mast. In this aspect, the first axial location 12 can be proximate the first end 214 of the drill mast 210. In exemplary aspects, the wireline assembly 10 can comprise a drum 14 configured for engagement with the drilling cable 140 (FIG. 19A).

In another aspect, the roller assembly 20 of the wireline system 100 can be operatively secured to the mast 210 at a second axial location 22 along the longitudinal axis 212 of the mast 210. In operation, the roller assembly 20 can be configured for engagement with the drilling cable 140 (FIG. 19A). In exemplary aspects, the wireline assembly 10 and the roller assembly 20 can be positioned within the front portion 206 of the drill rig 200, and at least a portion of the wireline assembly and at least a portion of the roller assembly can be axially spaced from the mast 210 along the second transverse axis 204. In various further aspects, it is contemplated that the wireline assembly 10 can be positioned behind the mast or on the deck of the drill rig.

In operation, it is contemplated that the drill head 230 can be moved away from the drilling axis 213 to enable the wireline system 100 to lift a core sample past the drilling head 230. In this way, the maximum height of the drilling head 230 does not serve as a limitation to the length of the core sample that can be retrieved with the wireline system 100. Accordingly, in some aspects, the core samples that can be retrieved with the disclosed drill rig can have a length of at least 4.5 meters, greater than 4.5 meters, at least 5 meters, at least 5.5 meters, at least 6 meters, or more. It is contemplated that these lengths can be equal or substantially equal to the lengths of the core barrels (inner tubes) from which the samples are retrieved. For example, in some aspects, it is contemplated that the disclosed drill rig can accommodate retrieval of inner tubes having a length of 6 meters.

In various aspects, the drill head 230 can be configured for movement about and between a first position (FIG. 1) in which the drilling axis 213 extends through the drill head and a second position (FIGS. 2-3) in which the drill head is spaced from the drilling axis 213. In the first position, the spindle of the drill head 230 can be coaxial with the drilling axis. In some aspects, an actuator 322 (e.g., a hydraulic cylinder) can move the drill head about and between the first and second positions.

Figure 6:
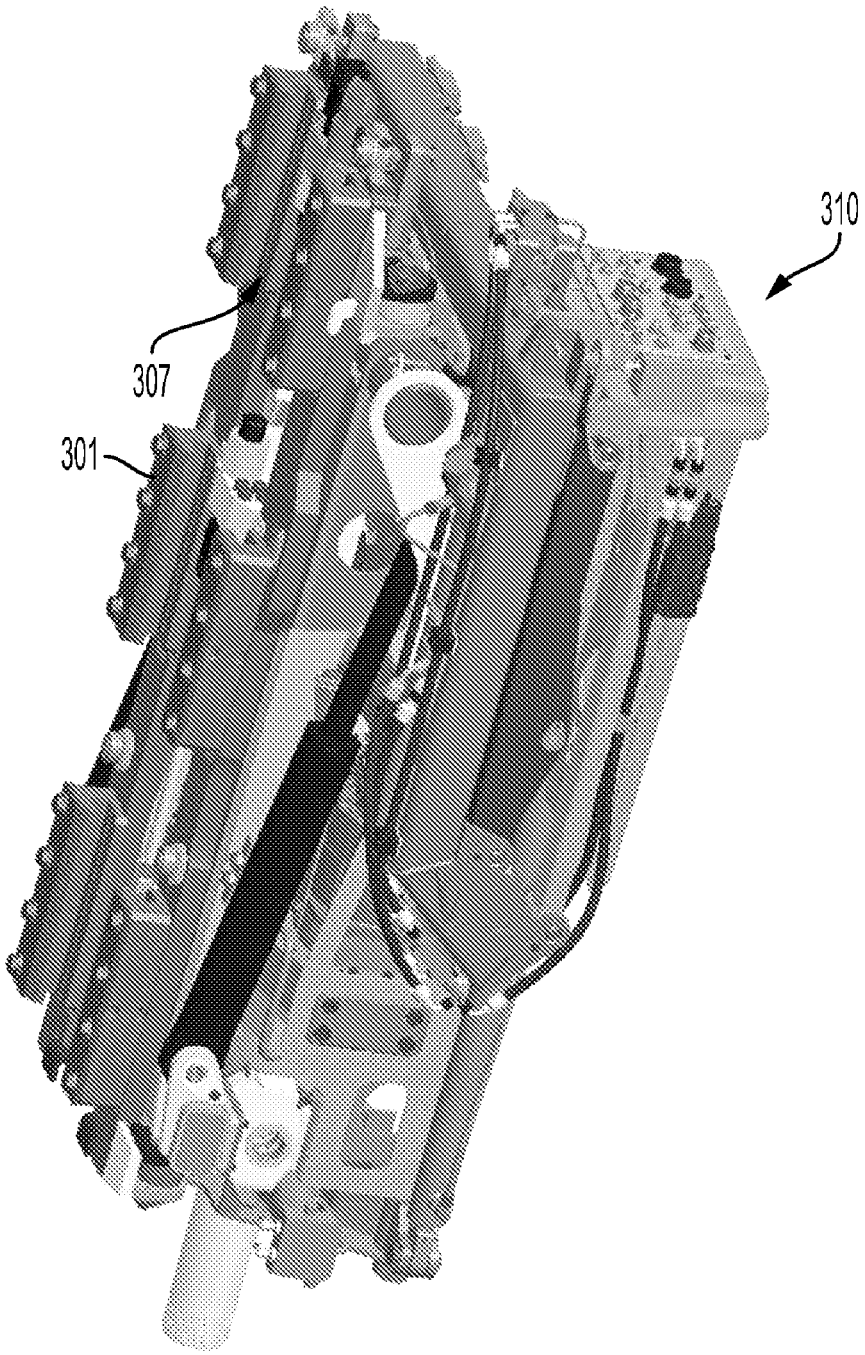
FIG. 6 is a rear perspective view of the drill head and the energy chain bracket assembly of the drill rig of FIG. 5.
Figure 14:
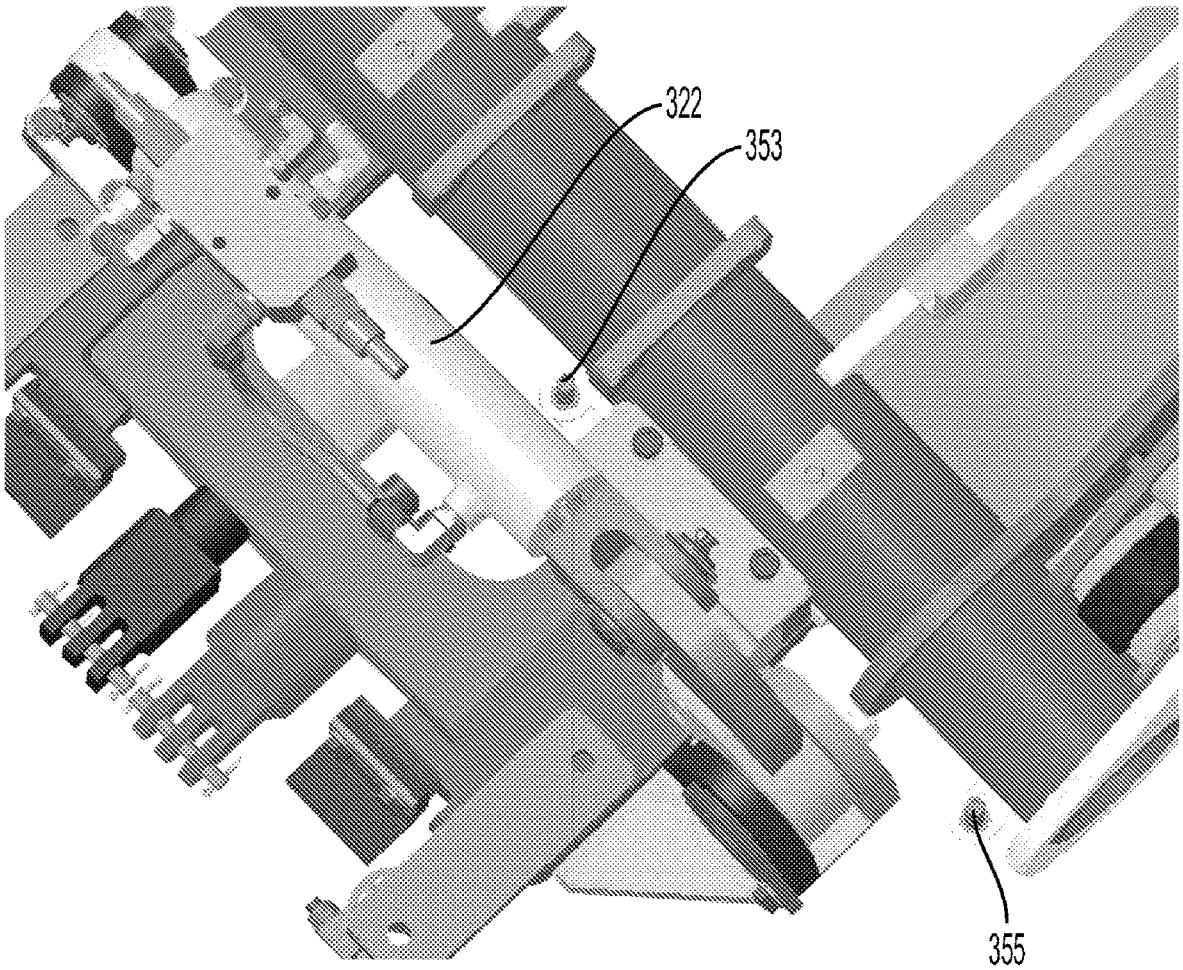
FIG. 14 is a partial perspective view of the carriage of FIG. 10, showing sensors for determining when the drill head is in the first and second positions.

In some aspects, that the drill head 230 can be pivotable about a pivot axis 300 from the first position to the second position. In some aspects, referring also to FIGS. 6 and 15, the drill head can couple to a carriage 301 that is movable along the mast. For example, the carriage can comprise slots 307 that receive and slide along tracks of the mast. The carriage 301 can comprise a first portion 303 that is not pivotable relative to the mast and a second portion 305 that is pivotably coupled to the first portion 303. The pivot axis 300 can optionally be parallel to, or substantially parallel to, the drilling axis 213. The carriage can comprise a first sensor 353 (FIG. 14) that is configured to determine when the drill head is in the first position (with the second portion 305 of the carriage 301 pivoted toward the first portion 303) and a second sensor 355 (FIG. 14) that is configured to determine when the drill head is in the second position (with the second portion 305 of the carriage 301 pivoted away from the first portion 303).

The drill rig 200 can comprise an energy chain 302 that can comprise electrical cables and hydraulic lines to provide electric power, hydraulic pressure, and control signals to the drill head 230. The energy chain 302 can comprise a first end 304 that couples to the drill head 230. For example, the energy chain 302 can couple to the drill head via an energy chain bracket assembly 310.

In some aspects, in a first (operation) configuration (FIGS. 1 and 6) at least a portion of the energy chain 302 (e.g., the first end 304) can be in the path of travel of the drill head 230 as the drill head moves from the first position to the second position. Accordingly, the energy chain bracket assembly 310 can be movable about and between the first configuration and a second configuration (FIG. 7) to move the energy chain 302 out of the path of travel of the drill head 230. In the second configuration of the energy chain bracket assembly 310, the first end of the energy chain 302 can be closer to the first end 214 of the mast 210 along the longitudinal axis than when the energy chain bracket assembly is in the first configuration. In further aspects, in the second configuration of the energy chain bracket assembly 310, the first end 304 of the energy chain 302 can be spaced from the mast by a greater distance along the transverse axis 204 than when the energy chain bracket assembly is in the first configuration.

Figure 8:
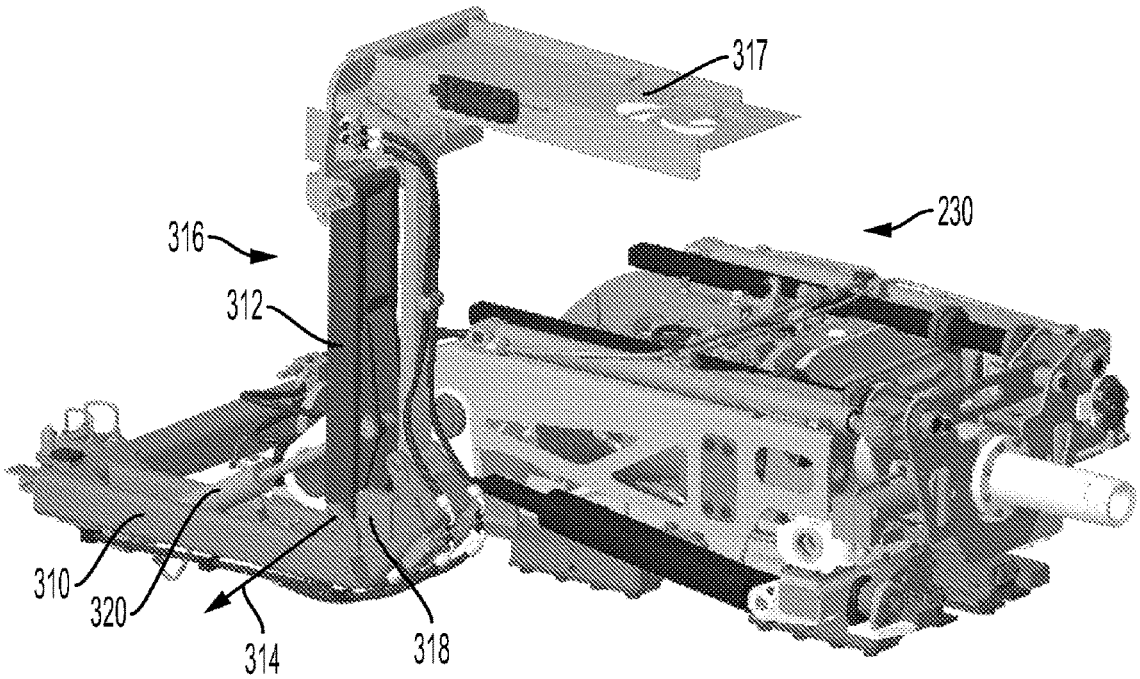
FIG. 8 is a bottom perspective view of the drill head and the energy chain bracket assembly of the drill rig of FIG. 5, with the energy chain bracket assembly in a second configuration.
Figure 9:
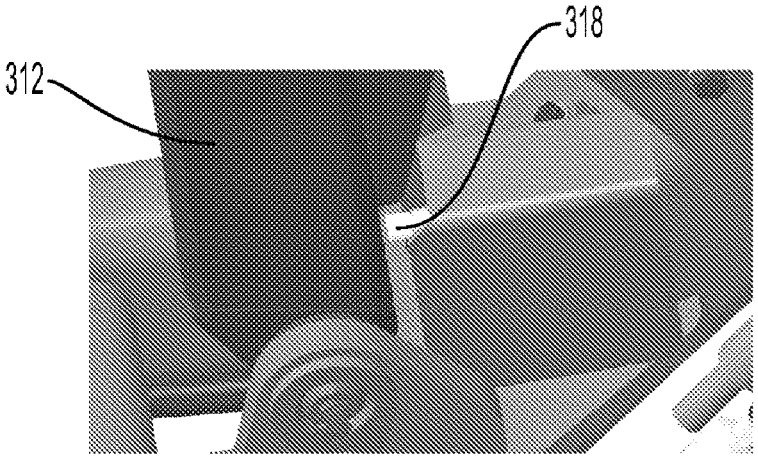
FIG. 9 is a partial perspective view of the energy chain bracket assembly, showing a sensor for determining when the energy chain bracket assembly is in the second configuration.
Figure 10:
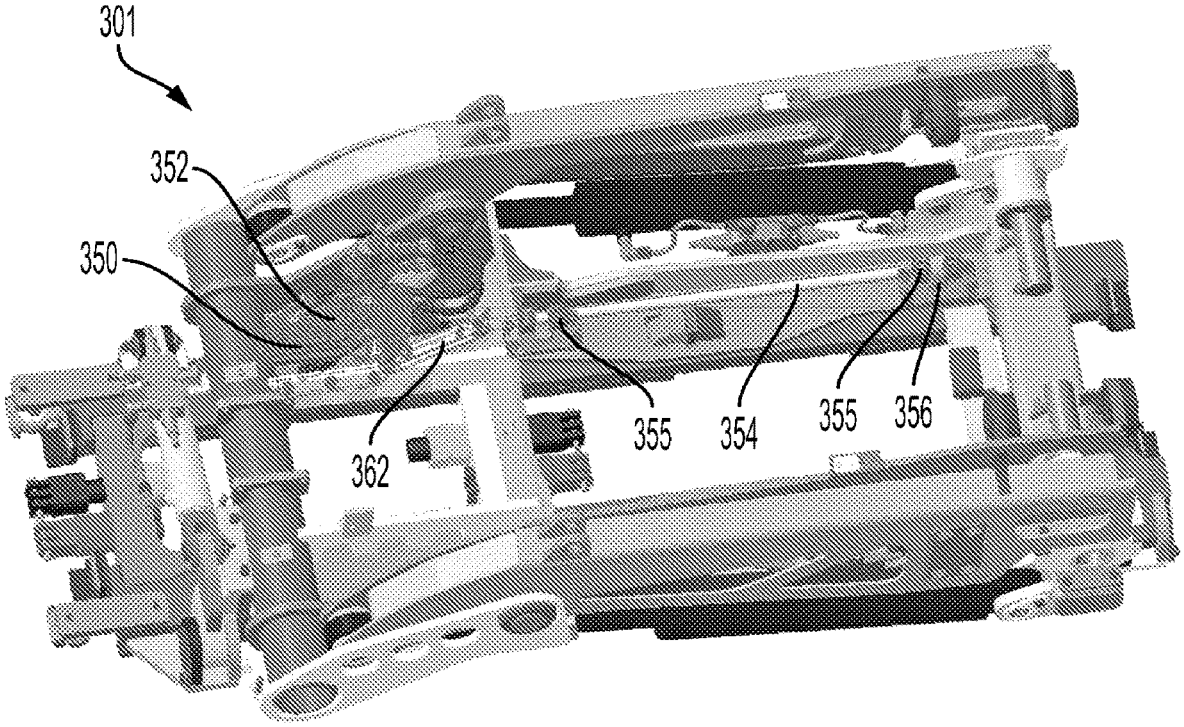
FIG. 10 is a front perspective view of a carriage that couples the drill head to the mast and moves the drill head about and between the first and second positions.
Figure 11:
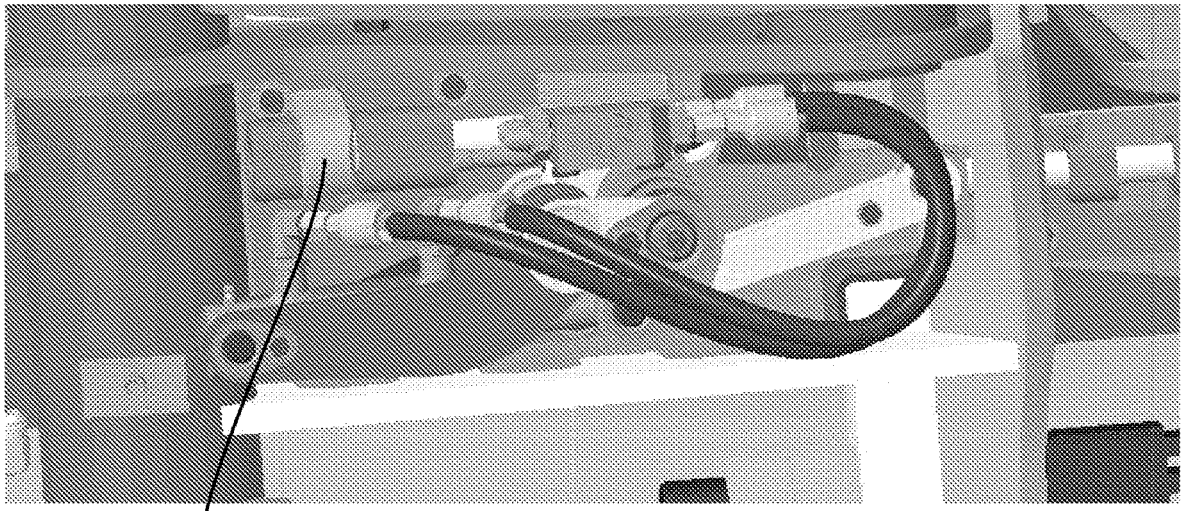
FIG. 11 is a partial perspective view of the carriage of FIG. 10, showing detail of a portion of a retainer for retaining the drill head in the first position.
Figure 12:
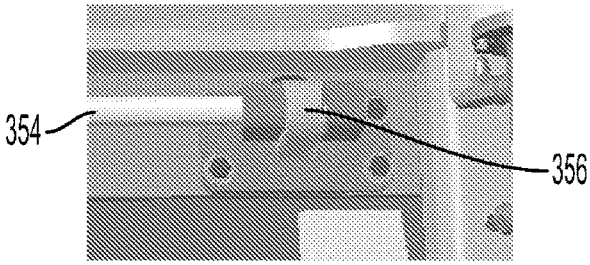
FIG. 12 is a partial perspective view of the carriage of FIG. 10, showing detail of a retainer for retaining the drill head in the first position.
Figure 13:
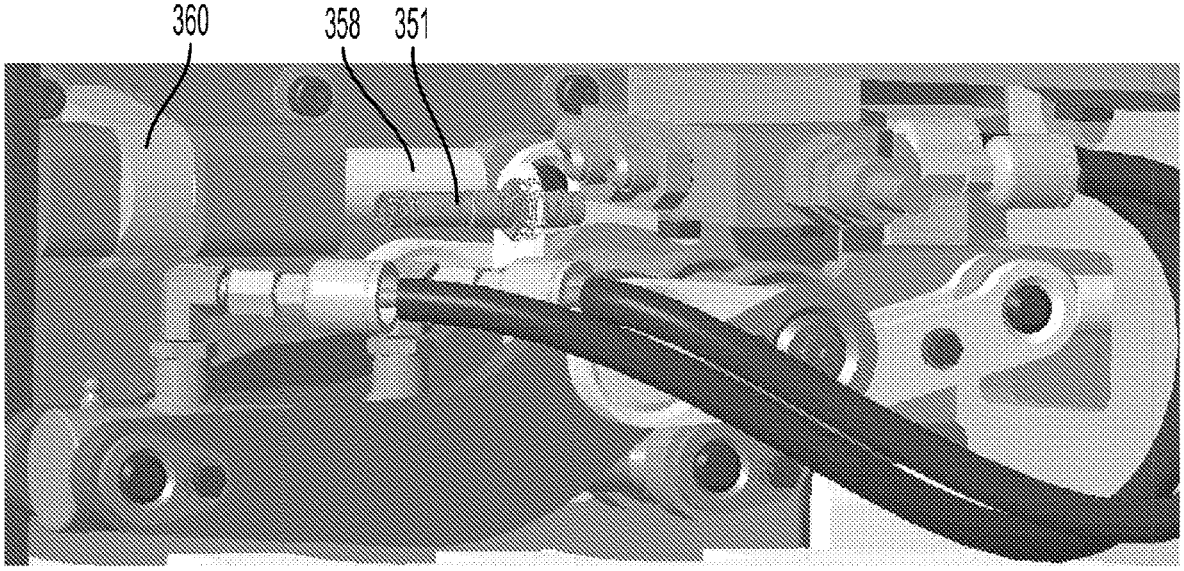
FIG. 13 is a partial perspective view of the carriage of FIG. 10, showing detail of a sensor for determining when the retainer is locked.

Optionally, with reference to FIG. 8, the energy chain bracket assembly 310 can comprise a pivot arm 312 that pivots about a pivotal axis 314. In further aspects, the energy chain bracket assembly 310 can comprise a four-bar linkage 316. The four-bar linkage 316 can comprise a distal arm 317 that remains is the same orientation (e.g., vertically oriented, as shown) relative to a vertical axis when the energy chain bracket assembly 310 is in both the first and second configurations. The first end 304 of the energy chain 302 can couple to the distal arm 317. In this way, as the pivot arm 312 pivots downwardly, the first end 304 of the energy chain 302 can move outwardly from the mast and downwardly along the mast without pivoting. An actuator 320 (e.g., hydraulic cylinder) can be configured to move the energy chain bracket assembly 310 about and between the first configuration and the second configuration.

It is contemplated that the drill rig 200 can comprise a first sensor 318 that is configured to detect when the energy chain bracket assembly 310 is in the second configuration. In this way, the drill rig 200 can have circuitry (e.g., a controller or other computing device) to prevent the drill head 230 from moving until the energy chain 310 is moved out of the way (with the energy chain bracket assembly 310 in the second configuration), thereby preventing the drill rig 200 from crashing into the energy chain 310.

Figure 7:
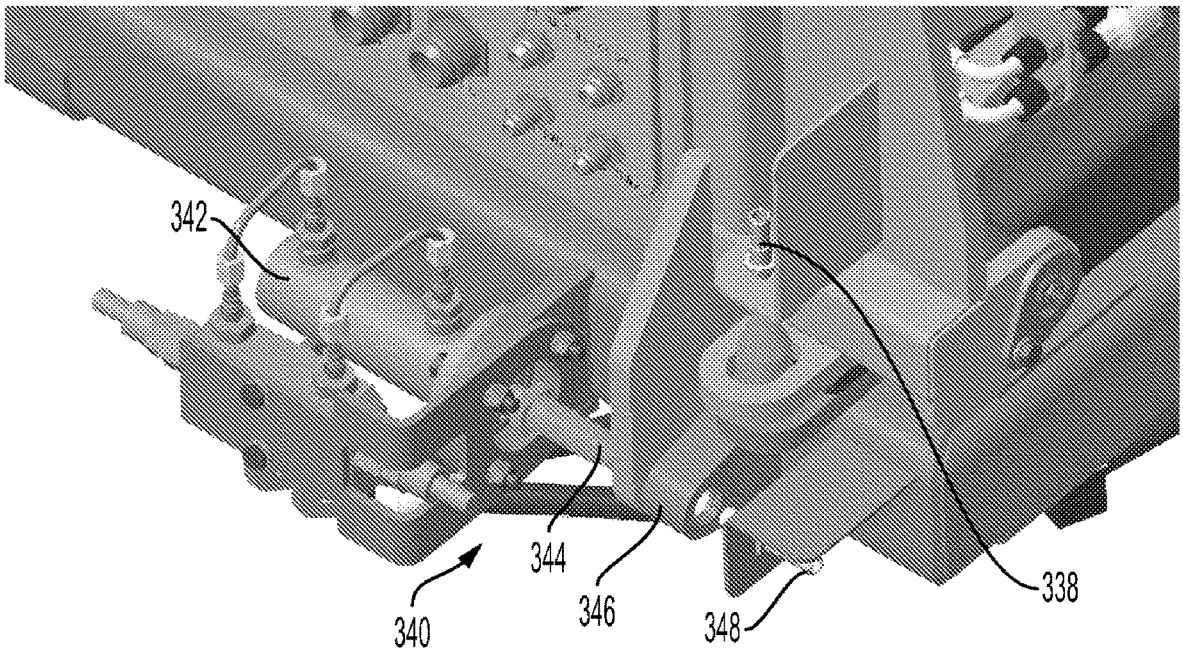
FIG. 7 is a partial perspective view of the energy chain bracket assembly in the first configuration, as in FIG. 5, showing a locking assembly.
Figure 21:
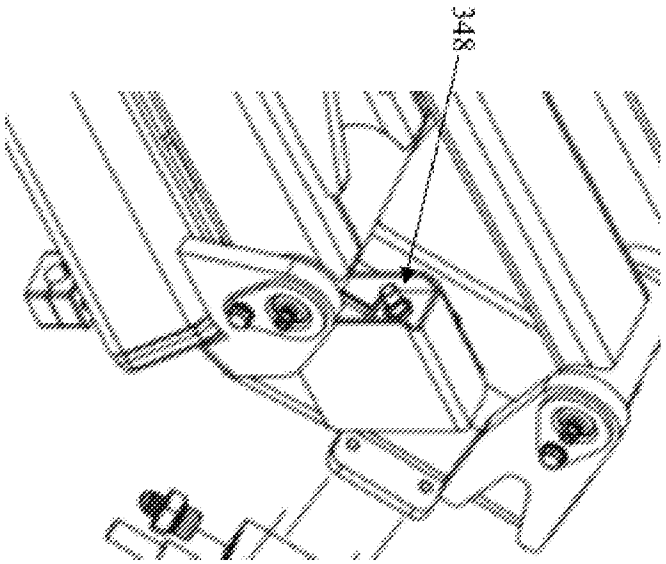
FIG. 21 is a partial perspective view of a portion of the energy chain bracket assembly, showing a sensor for determining when the energy chain bracket assembly is in the second configuration.

Referring also to FIG. 7, the energy chain bracket assembly 310 can comprise a second sensor 338 that is configured to detect when the energy chain bracket assembly is in the first configuration. The energy chain bracket assembly 310 can further comprise a lock 340 that is configured to retain the energy chain bracket assembly 310 in the first configuration. In some aspects the lock 340 can comprise a linear actuator 342 that drives a piston rod 344 through a catch 346. When the piston rod 344 is removed from the catch, the energy chain bracket assembly 310 can be allowed to pivot about and between the first and second configurations. The energy chain bracket assembly 310 can further comprise a third sensor 348 that detects whether the lock is engaged. In further aspects, the third sensor 348 can be positioned as shown in FIG. 21.

Referring to FIGS. 10-13, the carriage 301 can comprise a retainer 350 that locks the drill head 230 in a first position. The retainer 350 can comprise an actuator 352 that drives a first rod 354 through a first catch 356. The first rod can couple to the first portion 303 of the carriage 301, and the first catch 356 can couple to the second portion 305 of the carriage so that when the first rod extends through the first catch, the second portion of the carriage cannot pivot relative to the first portion. The first rod 354 can slide within bearings 355. Optionally, the actuator 352 can further drive a second rod 358 through a second catch 360. For example, in optional some aspects, the first and second rods 354, 358 can be coupled together via a linkage 362 that causes simultaneous movement of the first and second rods in opposing directions. In some aspects, the first and second catches 356, 360 can be spaced from each other (e.g., vertically spaced from each other) to prevent excessive torque to the drill head from a single location. The drill rig can comprise a sensor 351 that is configured to detect if the retainer 350 is locked.

Figure 15:
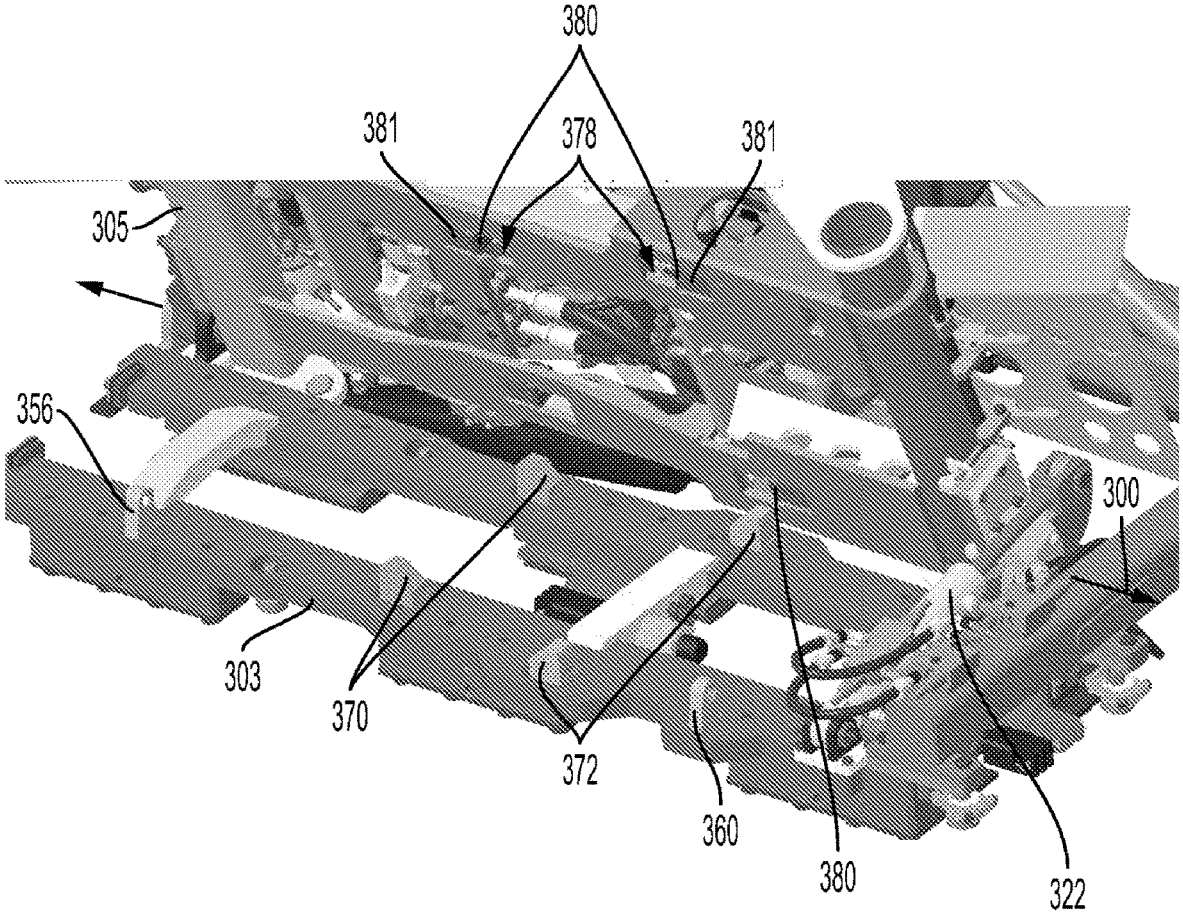
FIG. 15 is a partial perspective view of the carriage of FIG. 10, showing detail of a retainer for retaining the drill head in the first position.
Figure 16:
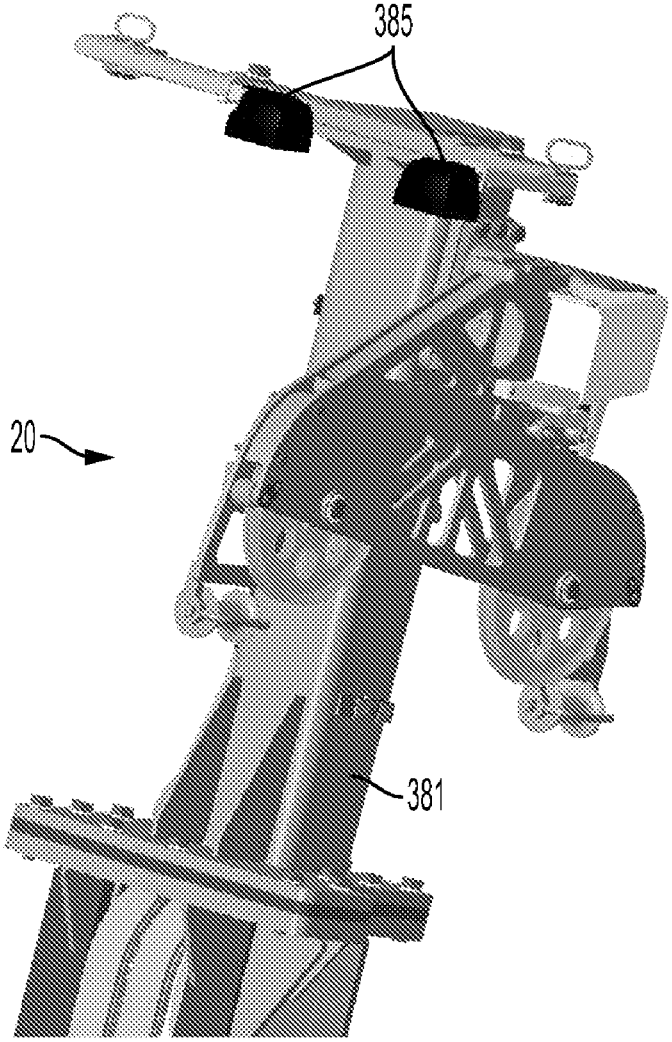
FIG. 16 is a perspective view of a roller assembly of the drill rig of FIG. 1.
Figure 17:
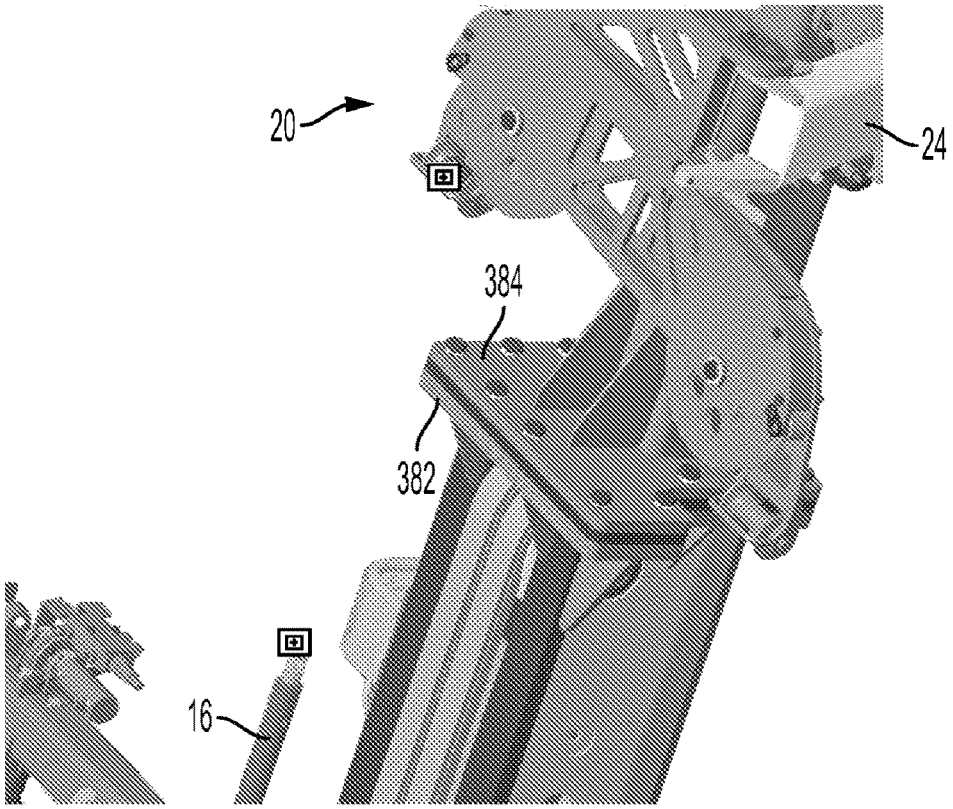
FIG. 17 is top partial perspective view of the drill rig of FIG. 1, showing an exemplary spacing from the roller assembly to an inner tube assembly.
Figure 18:
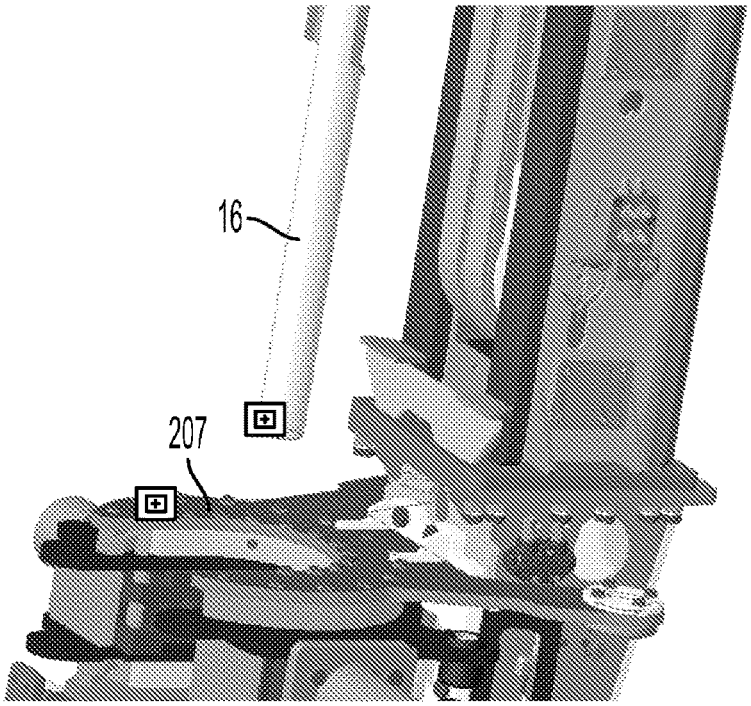
FIG. 18 is a partial perspective view of the drill rig of FIG. 1 holding an inner (core) tube assembly spaced from a foot clamp of the drill rig.

Referring to FIG. 15, the carriage 301 can comprise guides that orient the drill head as the drill head is returned to the first position from the second position. For example, the carriage 301 can comprise one or more tapered guides 370 (two shown) that are configured to engage a surface 374 of the drill head 230 to bias the drill head in an upward direction and one or more guides 372 that are configured to engage a surface 374 of the drill head 230 to bias the 230 to bias the drill head in a downward direction. Optionally, the surfaces 374, 376 can be inner surfaces of slots 378 formed in a portion of the drill head 230. In some aspects, the drill head 230 can comprise spacers 380 that engage the guides 370, 372 to enable the drill head to allow for manufacturing tolerances and to be adapted to seat in a desired vertical position.

Figure 4:
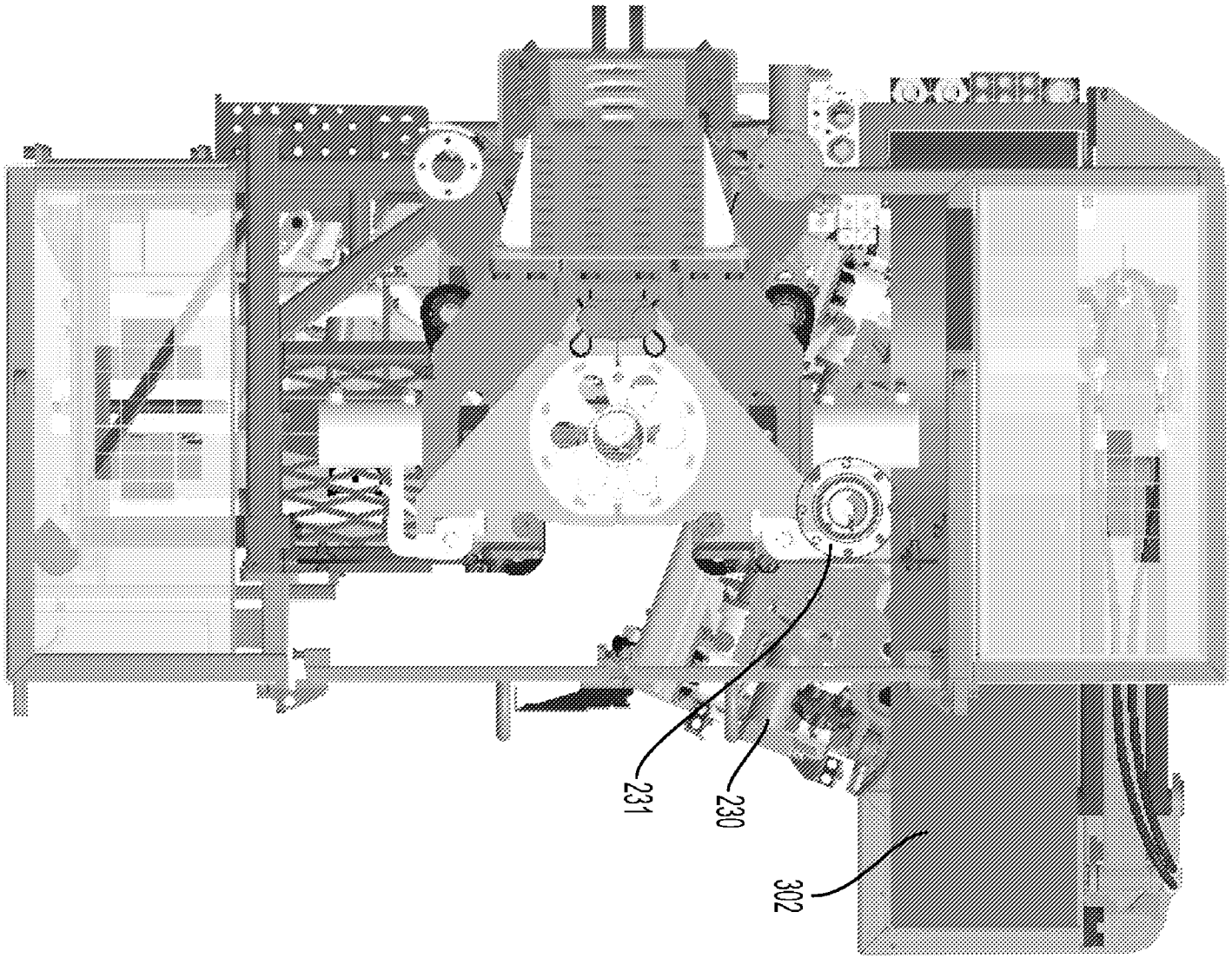
FIG. 4 is a bottom view of the drill rig of FIG. 2.
Figure 5:
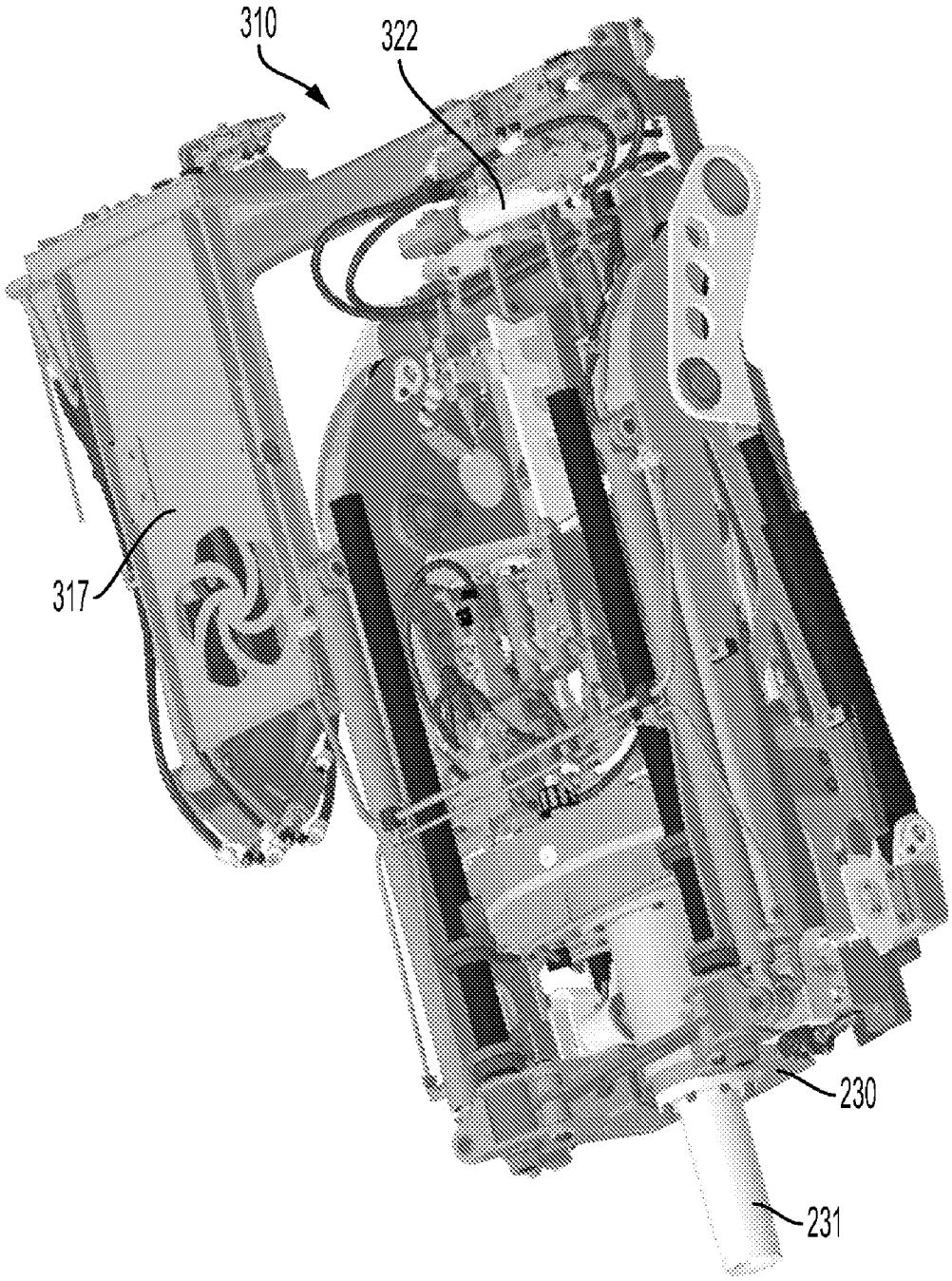
FIG. 5 is a front perspective view of the drill head and an energy chain bracket assembly of the drill rig of FIG. 1, with the energy chain bracket assembly in a first configuration.

As can be seen in FIG. 4, it is contemplated that when the drill head 230 is in the second position, a drill rod can be coupled to the drill head without the drill rod coming into contact with the energy chain. That is, second position of the drill head 230 can be sufficiently offset from the drilling axis but not so offset as to position a spindle 231 of the drill head over or otherwise in contact with the energy chain.

Referring to FIG. 16-20B, a roller assembly 20 can couple to the mast 210. The roller assembly 20 can comprise an extension arm 381 that extends from the second end 216 of the mast 210 in a direction away from the first end 214 of the mast 210. The length of the extension arm 381 along the longitudinal dimension of the mast can be selected to provide the necessary length from the roller assembly 20 to the foot clamp 207 in order to accommodate the desired inner tube assembly length. Accordingly, the length of the extension arm can be limited only by the stability of the drill rig. In various aspects, the mast can define a first flange 382, and the extension arm can define a second flange 384. The first and second flanges 382, 384 can receive bolts to couple the extension arm to the mast. It is contemplated that the coupling between the mast and the roller assembly 20 can allow the roller assembly to be coupled to the mast in multiple orientations based on rotation of the roller assembly about the longitudinal axis of the mast to thereby adapt the roller assembly based on the position of the wireline assembly 10 (e.g., on the side of the mast, behind the mast, or on the drill rig deck). Optionally, working lights 385 can be coupled to the extension arm 381.

In additional exemplary aspects, the roller assembly 20 can optionally comprise a support arm 24 coupled to the extension arm 381 and a pivot joint 26 operatively coupled to the support arm and configured for selective pivotal movement relative to the support arm to allow the roller assembly to direct wireline cable from the drum/winch to a location that is coaxial with the drilling axis. In further aspects, the roller assembly 20 can comprise opposed first and second sheaves 90*a*, 90*b* and a bracket 96 operatively secured to the pivot joint 26. In these aspects, the first and second sheaves 90*a*, 90*b* can each define a respective circumferential groove 92*a*, 92*b* and be configured for rotation about a respective rotational axis 94*a*, 94*b*. It is contemplated that the circumferential groove 92*a*, 92*b* of each sheave 90*a*, 90*b* can be configured to receive the wireline cable 140. It is further contemplated that the bracket 96 can be configured to engage the first and second sheaves 90*a*, 90*b* such that the rotational axes 94*a*, 94*b* of the first and second sheaves are parallel substantially parallel to one another and perpendicular or substantially perpendicular to the longitudinal axis 212 of the mast 210. In exemplary aspects, the bracket 96 can comprise first and second lightweight portions, with the first portion defining at least one hole configured to receive a first connector 91*a* and the second portion defining at least one hole configured to receive a second connector 91*b*. In these aspects, it is contemplated that the first connector 91*a* can be configured to couple the first sheave 90*a* to the first portion of the bracket 96, whereas the second connector 91*b* can be configured to couple the second sheave 90*b* to the second portion of the bracket. Optionally, in some aspects, the bracket 96 can be operatively coupled to the pivot joint 26 by a bolt or other fastener as is known in the art. Optionally, in other aspects, the first and second connectors 91*a*, 91*b* can be bolts or other fasteners as are known in the art. In further optional aspects, it is contemplated that the bracket 96 can be provided with bearings 126 that circumferentially surround at least a portion of the first and second connectors 91*a*, 91*b*. In further optional aspects, the roller assembly can be fixed so that it does not pivot relative to the support arm or the mast.

Figure 20A:
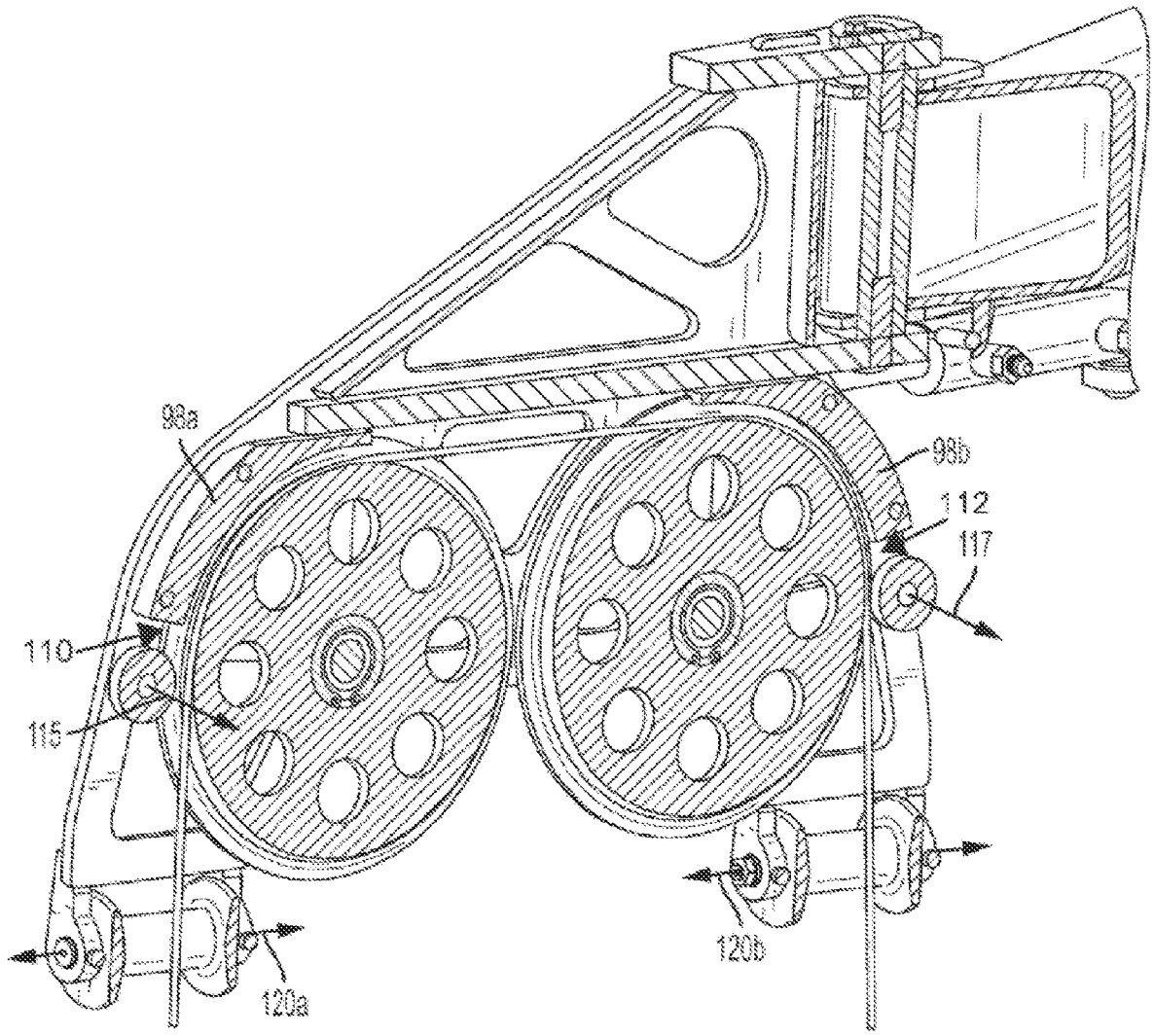
FIG. 20A is a cross-sectional perspective view of an exemplary roller assembly as disclosed herein.
Figure 20B:
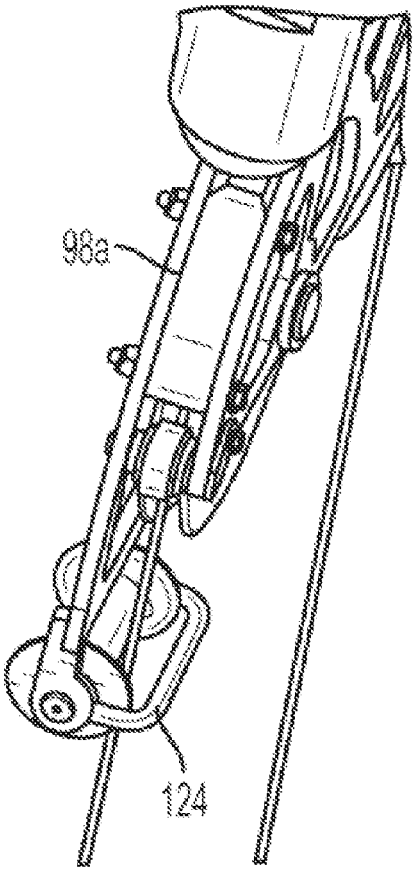
Figure 20C:
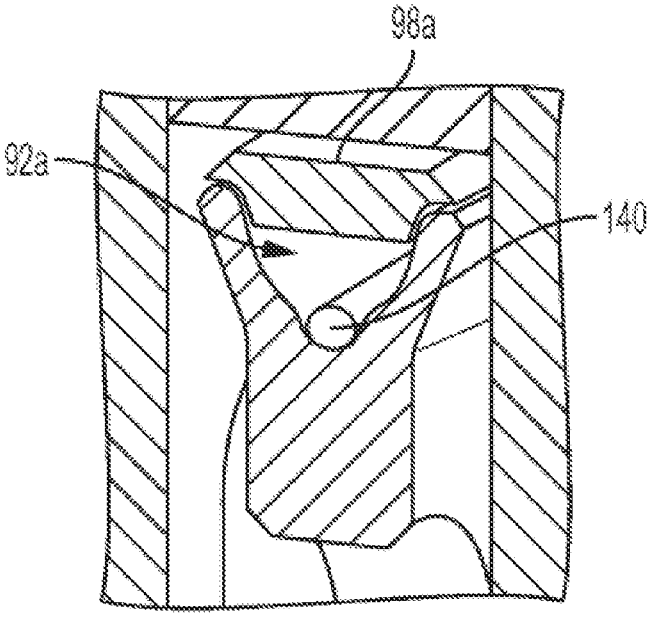

Optionally, in some exemplary aspects, and with reference to FIG. 20A, the roller assembly 20 can comprise opposed first and second guiding plates 98*a*, 98*b*. In these aspects, the first and second guiding plates 98*a*, 98*b* can be secured to the bracket 96. It is contemplated that the first guiding plate 98*a* can be spaced from and operatively positioned relative to the first sheave 90*a* to prevent the wireline cable 140 from disengaging the circumferential groove 92*a* of the first sheave. Similarly, it is contemplated that the second guiding plate 98*b* can be spaced from and operatively positioned relative to the second sheave 90*b* to prevent the wireline cable 140 from disengaging the circumferential groove 92*b* of the second sheave. It is contemplated that the separation between the guiding plates 98*a*, 98*b* and the sheaves 90*a*, 90*b* can be minimized to ensure that the cable is tightly received between the guiding plates and the sheaves. It is further contemplated that the guiding plates 98*a*, 98*b* can have corresponding, opposite contours relative to the first and second sheaves 90*a*, 90*b*, respectively. In exemplary aspects, the first and second guiding plates 98*a*, 98*b* can comprise plastic.

In further exemplary aspects, and with reference to FIGS. 19A-20A, the first guiding plate 98*a* can optionally cooperate with the circumferential groove 92*a* of the first sheave 90*a* to define an inlet 110 of the roller assembly 20. Similarly, it is contemplated that the second guiding plate 98*b* can cooperate with the circumferential groove 92*b* of the second sheave 90*b* to define an outlet 112 of the roller assembly 20.

In additional, optional aspects, the roller assembly 20 can further comprise at least one inlet roller 114 positioned proximate the inlet 110 of the roller assembly and spaced from the circumferential groove 92*a* of the first sheave 90*a*. In these aspects, the roller assembly 20 can still further comprise at least one outlet roller 116 positioned proximate the outlet 112 of the roller assembly and spaced from the circumferential groove 92*b* of the second sheave 90*b*. In operation, the at least one inlet roller 114 can be configured to guide a wireline cable 140 into the circumferential groove 92*a* of the first sheave 90*a*, and the at least one outlet roller 116 can be configured to guide the wireline cable as it exits the outlet 112 of the roller assembly. In exemplary aspects, it is contemplated that the at least one inlet roller 114 can have a corresponding, opposite or substantially opposite contour relative to the circumferential groove 92*a* of the first sheave 90*a*. Similarly, it is contemplated that the at least one outlet roller 116 can have a corresponding, opposite or substantially opposite contour relative to the circumferential groove 92*b* of the second sheave 90*b*. Thus, it is contemplated that the circumferential grooves 92*a*, 92*b* of the sheaves 90*a*, 90*b* can extend inwardly (into the sheaves) whereas the contoured surface of the inlet and outlet rollers 114, 116 can extend away from the sheaves. Optionally, in one aspect, the at least one inlet roller 114 and the at least one outlet roller 116 can be configured for rotation about respective rotational axes 115, 117. In this aspect, it is contemplated that the rotational axes 115, 117 of the at least one inlet roller 114 and the at least one outlet roller 116 can be parallel or substantially parallel to the rotational axes 94*a*, 94*b* of the first and second sheaves 90*a*, 90*b*. In further aspects, the at least one inlet roller 114 can optionally be configured to constrain movement of the wireline cable 140 relative to the rotational axis 115 of the at least one inlet roller as the wireline cable enters the inlet 110 of the roller assembly. Similarly, it is contemplated that the at least one outlet roller 116 can optionally be configured to constrain movement of the wireline cable 140 relative to the rotational axis 117 of the at least one outlet roller 116 as the wireline cable exits the outlet 112 of the roller assembly.

Optionally, in another exemplary aspect, the roller assembly 20 can further comprise a first guiding roller 118*a* spaced from the inlet 110 of the roller assembly relative to the longitudinal axis 212 of the mast 210 and a second guiding roller 118*b* spaced from the outlet 112 of the roller assembly relative to the longitudinal axis of the mast. In this aspect, the first guiding roller 118*a* can be configured for rotation about a rotational axis 120*a* that is perpendicular or substantially perpendicular to the rotational axes 94*a*. 94*b* of the first and second sheaves 90*a*, 90*b*. It is contemplated that the second guiding roller 118*b* can be configured for rotation about a rotational axis 120*b* that is perpendicular or substantially perpendicular to the rotational axes 94*a*, 94*b* of the first and second sheaves 90*a*, 90*b*. In operation, the first guiding roller 118*a* can be configured to engage the wireline cable 140 to constrain movement of the wireline cable relative to the rotational axis 120*a* of the first guiding roller 118*a* as the wireline cable approaches the inlet 110 of the roller assembly 20. It is further contemplated that the second guiding roller 118*b* can be configured to engage the wireline cable 140 to constrain movement of the wireline cable relative to the rotational axis 120*b* of the second guiding roller 118*b* as the wireline cable exits the outlet 112 of the roller assembly. In exemplary aspects, during "swinging" of the roller assembly, a small difference in an inlet run-angle of the drilling cable 140 can be created. In these aspects, it is contemplated that the first and second guiding rollers 118*a*, 118*b* can be configured to absorb the full range of the cable run-angle at the inlet 110 and outlet 112, thereby permitting guidance of the cable in both directions. In further exemplary aspects, and with reference to FIGS. 19A-20C, each of the first and second guiding rollers 118*a*, 118*b* can comprise a respective bow 124 that cooperates with the corresponding guiding roller to define an opening for receiving the drilling cable 140. In these aspects, the bow 124 can be configured to ensure that the cable 140 remains in operative communication with its associated guiding roller during operation of the drilling system.

It is contemplated that the drilling cable 140 can have a cross-sectional diameter, and that the first and second sheaves 90*a*, 90*b* can have a diameter. In exemplary aspects, it is contemplated that the cross-sectional diameter of the drilling cable 140 can be substantially less than the diameters of the first and second sheaves 90*a*, 90*b*. Optionally, it is contemplated that the ratio between the diameters of the first and second sheaves 90*a*, 90*b* and the cross-sectional diameter of the drilling cable 140 can be up to about 19:1.

In operation, the roller assembly can slew and/or slide in to the drilling line. It is contemplated that this slew and slide function can be initiated by an actuator 122 (e.g., hydraulic cylinder) (FIG. 19A) that can cause the roller assembly to stop in selected positions during the swing in function. For example, the actuator 122 can move the roller assembly to a first position in line with the drilling axis (in which the drilling axis is tangential to, or otherwise proximal to, the first sheave 90*a*) and a second position that is pivoted away from the drilling line. Respective sensors can be configured to determine when the roller assembly is in line with or pivoted away from the drilling line. Optionally, it is contemplated that the roller assembly and/or the wireline system can be mounted on the left or right side of the mast.

In exemplary aspects, at least a portion of the wireline assembly 10 and at least a portion of the roller assembly 20 can be axially spaced from the mast 210 and the drill head 230 in either direction relative to the first transverse axis 202, provided at least a portion of the wireline assembly 10 and at least a portion of the roller assembly 20 are positioned within the front portion 206 of the drill rig 200. In these aspects, the wireline assembly 10 and the roller assembly 20 can be axially aligned or substantially axially aligned along an axis. Optionally, it is contemplated that the axis 30 can extend at a selected angle relative to the longitudinal axis 212 of the mast 210. In some exemplary aspects, the selected angle can be a selected acute angle, such as, for example and without limitation, an acute angle ranging from about 5 degrees to about 60 degrees. Alternatively, in other optional aspects, the axis can extend parallel or substantially parallel to the longitudinal axis 212 of the mast 210. In further exemplary aspects, it is contemplated that the axis can correspond or substantially correspond to the axial pathway of the cable 140 between the wireline assembly 10 and the roller assembly 20.

In additional aspects, the wireline assembly can comprise a base portion and opposed first and second support brackets. In these aspects, it is contemplated that the drum can be positioned between the first and second support brackets. In further aspects, the drum can have a rotational axis and define an interior chamber extending axially relative to the rotational axis. In still further aspects, the wireline system can further comprise a motor (e.g., hydraulic motor). Optionally, in these aspects, the motor can be positioned at least partially within the interior chamber of the drum and operatively coupled to the drum. Upon activation of the motor, the drum can be configured to rotate about the rotational axis relative to the first and second support brackets. In exemplary aspects, the first and second support brackets can optionally define respective openings positioned in communication with the interior chamber of the drum.

In another aspect, the wireline system can further comprise a spooling device. In this aspect, the spooling device can be configured to receive the drilling cable from the drum and direct the drilling cable to the roller assembly. The spooling device can be further configured to guide the drilling cable to ensure winding and unwinding of the cable. In exemplary aspects, the spooling device can comprise a mounting bracket secured to the first and second support brackets. In these aspects, it is contemplated that the mounting bracket can optionally define an opening in communication with the interior chamber of the drum. It is further contemplated that the wireline assembly can comprise a safety guard that is configured to restrict access to the spooling device and the drilling cable during operation of the drilling system. In exemplary aspects, the spooling device and the drum can be supported by the base portion 17 of the wireline assembly. In these aspects, the base portion can optionally comprise at least two pairs of opposing legs that are connected together by cross bars.

The wireline assembly can be mounted to the first end of the mast using at least one support bracket. The at least one support bracket can optionally be configured to support the safety cage. The wireline assembly can optionally comprise at least one protective mesh element that circumferentially surrounds at least a portion of the drum. Optionally, in some aspects, the safety cage can be positioned to enclose at least a portion of the drum, including portions of the drum that are not surrounded by the at least one protective mesh element. In exemplary aspects, the safety cage can be provided with at least one door that permits selective access to the wireline system. In these aspects, it is contemplated that the at least one door can be selectively opened to permit efficient servicing and maintenance of the wireline system. When one or more doors of the safety cage are opened, free access to the drill string and the core barrel assembly are provided. It is contemplated that each door of the safety cage can be configured to open by about 180°. It is further contemplated that once a drill operator enters the safety cage through the at least one door, the drill operator is protected against injury by the protective mesh element and the safety guard. In further exemplary aspects, it is contemplated that the safety cage can comprise at least one secondary access door that provides access to the wireline assembly from outside the safety cage.

In operation, because the drilling cable is positioned in the front portion of the drill mast 200, it is contemplated that the drilling cable (including portions moving in an upward direction and portions moving in a downward direction) can be freely visible by an operator positioned proximate the control panel. In operation, because both the wireline assembly and the roller assembly are mounted or otherwise secured to the mast, it is further contemplated that an axial distance between the wireline assembly and the roller assembly relative to the longitudinal axis of the mast can remain constant or substantially constant. The consistency of this axial distance can protect against damage to components of the drilling system and avoid the need for additional securing measures when the drilling system is positioned in angled or transport positions. More particularly, in conventional wireline systems, in which the wireline assembly and the roller assembly are not both mounted to the mast, the distance between the wireline assembly and the roller assembly and the operative length of the cable are varied according to a dump function of the mast, the angle of drilling (e.g., 90° to 45°), and the transport position. In contrast, during initial setup of the drill rig disclosed herein, additional checking of the wireline assembly, roller assembly, and drilling cable is not required. In exemplary aspects, it is contemplated that the axial distance between the wireline assembly and the roller assembly can be over 4 m and thereby creates a soft run within the roller assembly. In these aspects, it is further contemplated that the soft run can be created by positioning the mounting bracket such that the opening of the mounting bracket is angled to receive the drilling cable at the selected angle.

In further optional aspects, the wireline can be positioned behind the mast or on the deck of the drill rig, as in conventional drill rigs. Accordingly, it is contemplated that drill rigs having different mast types and lengths and having wireline assemblies in various placements can be adapted as disclosed herein to increase the maximum length of a core sample that can be retrieved. Moreover, it is contemplated that positioning the wireline assembly behind the mast (instead of to the side) can allow the cable to move through the roller assembly 20.

In various optional aspects, the drill head 230 can be a top drive head. In further aspects, the drill head can be a chuck drive. In some aspects, the drill head can be a tiltable head (e.g., so that can tilt about a horizontal pivotal axis). In further aspects, the drill head can be a fixed head (that cannot tilt about such a horizontal pivotal axis).

It is contemplated that the safety cage can be sufficiently small to enable transport of the system.

It is contemplated that the system herein can comprise logic circuitry, using feedback from the sensors (e.g., the first, second, and third sensors 318, 338, 348), to control operation of the drill rig. In this way, crashing of various components of the drill rig and drill string can be prevented. For example, the logic circuitry can have a drilling mode and a wireline mode. Movement of the drill head 230 about and between the first and second positions and movement of the energy chain bracket assembly 310 can be inhibited when in the drilling mode. Optionally, an operator can initiate transition between drilling mode and wireline mode. For example, via an input device (e.g., a touchscreen, keyboard, switch, or any suitable input device, the operator can select between the drilling mode and the wireline mode. To transition to wireline mode, the energy chain bracket assembly 310 can first be released (e.g., the lock 340 can be disengaged) to allow movement from the first configuration to the second confirmation. Once the third sensor 348 detects that the energy chain bracket assembly 310 has been released, the actuator 320 can be actuated to move the energy chain bracket assembly 310 to the second configuration, thereby moving the energy chain 302 out of the way of the drill head. Once the first sensor 318 detects that the energy chain bracket assembly 310 is in the second configuration, the logic circuitry can allow the retainer 350 to be released (e.g., the actuator 352 can actuate the first and second rods 354, 358 into engagement with the respective first and second catches 356, 360). The sensor 351 can detect release of the retainer 350. Once the sensor 351 detects release of the retainer 350, the logic circuitry can allow the actuator 322 to move the drill head from the first position to the second position. Once the sensor 355 detects that the drill head is in the second position, the roller assembly actuator can slew the roller assembly into the drilling line, and the respective sensor of the roller assembly can detect when the roller assembly is in the drilling line. Optionally, all of the foregoing steps can be performed automatically upon the operator selecting wireline mode. In further aspects, the operator can initiate one or more of the steps, and the logic circuitry can prevent steps from being initiated out of order.

To switch back to drilling mode, the opposite of the transition from drilling mode to wireline mode can take place. The wireline actuator can slew the roller assembly away from the drilling line, and the respective sensor can detect when the roller assembly is in its position away from the drilling line. Upon sensing the roller assembly being pivoted away, the logic circuitry can allow the actuator 322 to move the drill head to the first position. The sensor 353 (FIG. 14) can detect when the drill head is in the first position. Upon detecting that the drill head is in the first position, the retainer 350 can lock the drill head in the first position. The sensor 350 can detect said engagement of the retainer 350. Upon sensing the engagement of the retainer, the logic circuitry can allow the energy chain bracket assembly 310 to move to the first position. Upon the second sensor 338 detecting that the energy chain bracket assembly 310 is in the first position, the logic circuitry can allow the lock 340 to engage. Upon the sensor 348 sensing the locking of the lock 340, the drill rig can be in drilling mode.

Optionally, the logic circuitry, as disclosed herein, can be embodied as a microcontroller or computing device that is integral to the drill rig and the actuators and sensors thereof. In further aspects, the logic circuitry can be embodied as a separate controller or computing device (e.g., a personal computer, tablet, desktop, or smartphone) in communication with the drill rig. An exemplary computing device is described further herein with reference to FIG. 22.

Optionally, in exemplary aspects, the various sensors described herein (e.g., sensors 318, 338, 348, 349, 351, 353, 355) can be any type of sensor that is capable of detecting a change of position of a component of drill rig as disclosed herein. For example, in some optional aspects, it is contemplated that one or more of the various sensors can be a proximity sensor. In these aspects, it is contemplated that the proximity sensor can emit an electromagnetic beam or field and detect a change in a return response, which can be indicative of a change of position of one or more components of the disclosed drill rig. In other optional aspects, it is contemplated that one or more of the various sensors described herein can be a momentary switch. For example, a portion of a component of the disclosed drill rig (e.g., the energy chain bracket assembly 310) can contact a momentary switch when the component is in a particular configuration (e.g., the second configuration of the energy chain bracket assembly). In still further optional aspects, it is contemplated that one or more of the various sensors described herein can be a rotary sensor that senses the position of one or more components of the disclosed drill rig. Thus, in use, sensors 353, 355 can be configured to detect a change in position of the drill head and/or carriage or a drill rig component associated with the drill head and/or carriage. Similarly, sensors 318, 338, 348, 349 can be configured to detect a change in position of the energy chain bracket assembly or a component (e.g., a lock) associated with the energy chain bracket assembly. Further, sensor 351 can be configured to detect a change in position of the retainer or a component (e.g., a lock) associated with the retainer.

A method of using the drill rig as disclosed herein can comprise using the drill rig to drill a core sample within a borehole. The energy chain can be moved into a position to allow transverse movement of the drill head (e.g., the energy chain bracket assembly can be moved to the second configuration). The drill head can be moved to the second position. The roller assembly of the wireline rig can be moved into the drilling line. The wireline can then be used to pull the core sample from the borehole.

Although embodiments disclosed herein are generally directed to the drilling head being pivotably coupled to the mast about a pivot axis 300, other embodiments for moving the drill head 230 are contemplated. For example, in some aspects, the drill head 230 can be laterally shifted (with or without pivoting) toward and away from the drilling axis 213 (e.g., along the first and/or second transverse axes 202, 204). For example, in further aspects, the drill head 230 can be slidable toward and away from the drilling axis along tracks. In further aspects, a multiple-arm linkage can enable the drill head 230 to move toward and away from the drilling axis 213.

Further details of drill rigs, systems, and wireline assemblies in accordance with the present disclosure are provided in U.S. Pat. No. 10,384,907, granted Aug. 20, 2019, the entirety of which is hereby incorporated by reference herein for all purposes.

Computing Device

Figure 22:
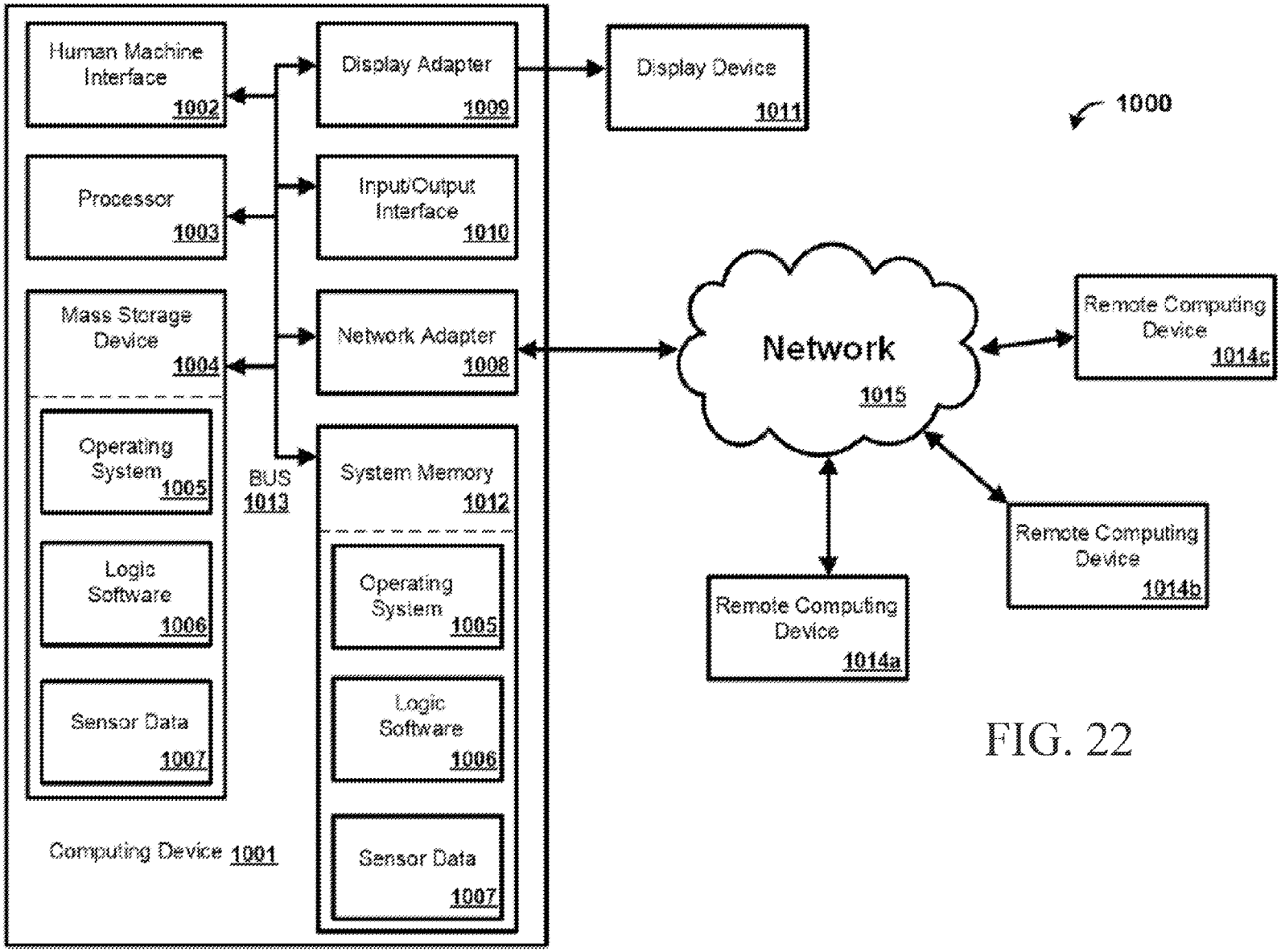
FIG. 22 is a system comprising a computing device for use with the drill rig as disclosed herein.

FIG. 22 shows a system 1000 including an exemplary configuration of a computing device 1001 for use with the drill rig 200 (e.g., to provide the logic circuitry). In some aspects, the computing device 1001 can be integral to the drill rig 200. In further aspects, it is contemplated that a separate (e.g., remote) computing device, such as, for example, a tablet, smartphone, laptop, or desktop computer can communicate with the drill rig 200 and can enable the operator to interface with the drill rig 200.

The computing device 1001 may comprise one or more processors 1003, a system memory 1012, and a bus 1013 that couples various components of the computing device 1001 including the one or more processors 1003 to the system memory 1012. In the case of multiple processors 1003, the computing device 1001 may utilize parallel computing.

The bus 1013 may comprise one or more of several possible types of bus structures, such as a memory bus, memory controller, a peripheral bus, an accelerated graphics port, and a processor or local bus using any of a variety of bus architectures.

The computing device 1001 may operate on and/or comprise a variety of computer readable media (e.g., non-transitory). Computer readable media may be any available media that is accessible by the computing device 1001 and comprises, non-transitory, volatile and/or non-volatile media, removable and non-removable media. The system memory 1012 has computer readable media in the form of volatile memory, such as random access memory (RAM), and/or non-volatile memory, such as read only memory (ROM). The system memory 1012 may store data such as sensor data 1007 (i.e., data from signals received by the electrodes) and/or program modules such as operating system 1005 and logic software 1006 that are accessible to and/or are operated on by the one or more processors 1003.

The computing device 1001 may also comprise other removable/non-removable, volatile/non-volatile computer storage media. The mass storage device 1004 may provide non-volatile storage of computer code, computer readable instructions, data structures, program modules, and other data for the computing device 1001. The mass storage device 1004 may be a hard disk, a removable magnetic disk, a removable optical disk, magnetic cassettes or other magnetic storage devices, flash memory cards, CD-ROM, digital versatile disks (DVD) or other optical storage, random access memories (RAM), read only memories (ROM), electrically erasable programmable read-only memory (EEPROM), and the like.

Any number of program modules may be stored on the mass storage device 1004. An operating system 1005 and logic software 1006 may be stored on the mass storage device 1004. One or more of the operating system 1005 and logic software 1006 (or some combination thereof) may comprise program modules and the logic software 1006. Sensor data 1007 may also be stored on the mass storage device 1004. Sensor data 1007 may be stored in any of one or more databases known in the art. The databases may be centralized or distributed across multiple locations within the network 1015.

A user may enter commands and information into the computing device 1001 using an input device (not shown). Such input devices comprise, but are not limited to, a keyboard, touchscreen display, pointing device (e.g., a computer mouse, remote control), a microphone, a joystick, a scanner, tactile input devices such as gloves, and other body coverings, motion sensor, speech recognition, and the like. These and other input devices may be connected to the one or more processors 1003 using a human machine interface 1002 that is coupled to the bus 1013, but may be connected by other interface and bus structures, such as a parallel port, game port, an IEEE 1394 Port (also known as a Firewire port), a serial port, network adapter 1008, and/or a universal serial bus (USB).

A display device 1011 may also be connected to the bus 1013 using an interface, such as a display adapter 1009. It is contemplated that the computing device 1001 may have more than one display adapter 1009 and the computing device 1001 may have more than one display device 1011. A display device 1011 may be a monitor, an LCD (Liquid Crystal Display), light emitting diode (LED) display, television, smart lens, smart glass, and/or a projector. In addition to the display device 1011, other output peripheral devices may comprise components such as speakers (not shown) and a printer (not shown) which may be connected to the computing device 1001 using Input/Output Interface 1010. Any step and/or result of the methods may be output (or caused to be output) in any form to an output device. Such output may be any form of visual representation, including, but not limited to, textual, graphical, animation, audio, tactile, and the like. The display 1011 and computing device 1001 may be part of one device, or separate devices.

The computing device 1001 may operate in a networked environment using logical connections to one or more remote computing devices 1014*a,b,c*. A remote computing device 1014*a,b,c* may be a personal computer, computing station (e.g., workstation), portable computer (e.g., laptop, mobile phone, tablet device), smart device (e.g., smartphone, smart watch, activity tracker, smart apparel, smart accessory), security and/or monitoring device, a server, a router, a network computer, a peer device, edge device or other common network node, and so on. Logical connections between the computing device 1001 and a remote computing device 1014*a,b,c* may be made using a network 1015, such as a local area network (LAN) and/or a general wide area network (WAN), or a Cloud-based network. Such network connections may be through a network adapter 1008. A network adapter 1008 may be implemented in both wired and wireless environments. Such networking environments are conventional and commonplace in dwellings, offices, enterprise-wide computer networks, intranets, and the Internet. It is contemplated that the remote computing devices 1014*a,b,c* can optionally have some or all of the components disclosed as being part of computing device 1001. In various further aspects, it is contemplated that some or all aspects of data processing described herein can be performed via cloud computing on one or more servers or other remote computing devices. Accordingly, at least a portion of the system 1000 can be configured with internet connectivity.

EXEMPLARY ASPECTS

In view of the described products, systems, and methods and variations thereof, herein below are described certain more particularly described aspects of the invention. These particularly recited aspects should not however be interpreted to have any limiting effect on any different claims containing different or more general teachings described herein, or that the "particular" aspects are somehow limited in some way other than the inherent meanings of the language literally used therein.

Aspect 1: A drill rig having a drilling axis, the drill rig comprising: a mast having a longitudinal axis and opposed first and second ends, the first end of the mast being configured for positioning proximate a drilling formation; a drill head coupled to the mast and configured to impart rotation to a drill string, wherein the drill head is configured for movement about and between: a first position in which the drilling axis extends through the drill head; and a second position in which drill head is spaced from the drilling axis.

Aspect 2: The drill rig of aspect 1, further comprising a carriage that is movable relative to the mast along the longitudinal axis of the mast, wherein the drill head is pivotably coupled to the carriage about a pivot axis, wherein the first position of the drill head is pivotally offset from the second position about the pivot axis.

Aspect 3: The drill rig of aspect 2, further comprising at least one actuator that is configured to move the drill head from the first position to the second position.

Aspect 4: The drill rig of any one of the preceding aspects, further comprising a wireline system, the wireline system comprising: a winch configured for engagement with a drilling cable; and a roller assembly configured for engagement with the drilling cable and coupled to the second end of the mast, wherein at least a portion of the roller assembly extends beyond the second end of the mast along the longitudinal axis of the mast in a direction away from the first end of the mast.

Aspect 5: The drill rig of aspect 4, wherein an entirety of the roller assembly is positioned beyond the second end of the mast along the longitudinal axis of the mast in the direction away from the first end of the mast.

Aspect 6: The drill rig of aspect 4 or aspect 5, wherein the roller assembly is configured to slew about an axis that is parallel to the longitudinal axis of the mast.

Aspect 7: The drill rig of any one of the preceding aspects, further comprising: an energy chain having a first end; and an energy chain bracket assembly that is coupled to the drill head and axially movable along the mast with the drill head, wherein the first end of the energy chain is coupled to the energy chain bracket assembly, wherein the energy chain bracket assembly is movable about and between a first configuration and a second configuration, wherein when the energy chain bracket assembly is in the first configuration, the first end of the energy chain is in a first position, wherein, when the energy chain bracket is in the second configuration, the first end of the energy chain is in a second position, wherein the second position of the first end of the energy chain is closer to the first end of the mast along the longitudinal axis than the first position of the first end of the energy chain.

Aspect 8: The drill rig of aspect 7, wherein the first position of the first end of the energy chain is closer to the longitudinal axis of the mast along a transverse axis that is perpendicular to the longitudinal axis than the second position of the first end of the energy chain.

Aspect 9: The drill rig of aspect 7 or aspect 8, further comprising a lock that, when engaged, is configured to inhibit the energy chain bracket assembly from moving from the first configuration to the second configuration.

Aspect 10: The drill rig of any one of aspects 7-9, further comprising a first sensor that is configured to detect when the energy chain bracket assembly is in the first configuration, wherein the drill rig further comprises logic circuitry in communication with the first sensor that inhibits the drill head from moving from the first position to the second position when the first sensor detects that the energy chain bracket assembly is in the first configuration.

Aspect 11: The drill rig of any one of the preceding aspects, further comprising a retainer that is configured to fix the drill head in the first position.

Aspect 12: A method of using the drill rig as in any one of aspects 7-11, the method comprising: moving the energy chain bracket assembly from the first configuration to the second configuration; and moving the drill head from the first position to the second position.

Aspect 13: The method of aspect 12, wherein the drill rig comprises a roller assembly coupled to the second end of the mast, wherein the roller assembly is configured to slew about a slewing axis that is parallel to the longitudinal axis of the mast, the method further comprising slewing the roller assembly about the slewing axis so that at least a portion of the roller assembly is in line with the drilling axis.

Aspect 14: The method of aspect 13, further comprising using a wireline assembly of the drill rig to pull an inner tube assembly from a borehole.

Aspect 15: The method of aspect 14, further comprising slewing the roller assembly away from the drilling axis.

Aspect 16: The method of aspect 15, further comprising: moving the drill head from the second position to the first position; and moving the energy chain bracket assembly from the second configuration to the first configuration.

Although the foregoing invention has been described in some detail by way of illustration and example for purposes of clarity of understanding, certain changes and modifications may be practiced within the scope of the appended claims.

The invention claimed is:

1. A drill rig having a drilling axis, the drill rig comprising:

a mast having a longitudinal axis and opposed first and second ends, the first end of the mast being configured for positioning proximate a drilling formation;

a drill head coupled to the mast and configured to impart rotation to a drill string, wherein the drill head is configured for movement about and between:

a first position in which the drilling axis extends through the drill head; and a second position in which drill head is spaced from the drilling axis;

an energy chain having a first end; and an energy chain bracket assembly that is coupled to the drill head and axially movable along the mast with the drill head, wherein the first end of the energy chain is coupled to the energy chain bracket assembly, wherein the energy chain bracket comprises a pivot arm having a distal end, wherein the energy chain bracket assembly is movable about and between a first configuration, in which the pivot arm extends upwardly along the mast, and a second configuration, in which the pivot arm extends outwardly from the mast, wherein the energy chain is coupled to the pivot arm so that when the energy chain bracket assembly is in the first configuration, the first end of the energy chain is in a first position, wherein, when the energy chain bracket is in the second configuration, the first end of the energy chain is in a second position, wherein the second position of the first end of the energy chain is closer to the first end of the mast along the longitudinal axis than the first position of the first end of the energy chain, and wherein, along a transverse axis that is perpendicular to the longitudinal axis, the first position of the first end of the energy chain is spaced from the longitudinal axis by a first distance and the second position of the first end of the energy chain is spaced from the longitudinal axis by a second distance that is greater than the first distance.

2. The drill rig of claim 1, further comprising a carriage that is movable relative to the mast along the longitudinal axis of the mast, wherein the drill head is pivotably coupled to the carriage about a pivot axis, wherein the first position of the drill head is pivotally offset from the second position about the pivot axis.

3. The drill rig of claim 2, further comprising at least one actuator that is configured to move the drill head from the first position to the second position.

4. The drill rig of claim 2, further comprising a wireline system, the wireline system comprising:

a winch configured for engagement with a drilling cable; and a roller assembly configured for engagement with the drilling cable and coupled to the second end of the mast, wherein at least a portion of the roller assembly extends beyond the second end of the mast along the longitudinal axis of the mast in a direction away from the first end of the mast.

5. The drill rig of claim 1, further comprising a wireline system, the wireline system comprising:

a winch configured for engagement with a drilling cable; and a roller assembly configured for engagement with the drilling cable and coupled to the second end of the mast, wherein at least a portion of the roller assembly extends beyond the second end of the mast along the longitudinal axis of the mast in a direction away from the first end of the mast.

6. The drill rig of claim 5, wherein an entirety of the roller assembly is positioned beyond the second end of the mast along the longitudinal axis of the mast in the direction away from the first end of the mast.

7. The drill rig of claim 5, wherein the roller assembly is configured to slew about an axis that is parallel to the longitudinal axis of the mast.

8. The drill rig of claim 1, further comprising a lock that, when engaged, is configured to inhibit the energy chain bracket assembly from moving from the first configuration to the second configuration.

9. The drill rig of claim 1, further comprising a first sensor that is configured to detect when the energy chain bracket assembly is in the first configuration, wherein the drill rig further comprises logic circuitry in communication with the first sensor that inhibits the drill head from moving from the first position to the second position when the first sensor detects that the energy chain bracket assembly is in the first configuration.

10. The drill rig of claim 1, further comprising a first sensor that is configured to detect when the energy chain bracket assembly is in the first configuration, wherein the drill rig further comprises logic circuitry in communication with the first sensor that inhibits the drill head from moving from the first position to the second position when the first sensor detects that the energy chain bracket assembly is in the first configuration.

11. The drill rig of claim 1, further comprising a retainer that is configured to fix the drill head in the first position.

12. The drill rig of claim 1, wherein the energy chain bracket assembly comprises:

a four-bar linkage wherein the four-bar linkage comprises the pivot arm, and a distal arm, wherein the distal arm is coupled to the four-bar linkage at the distal end of the pivot arm so that the distal arm so that the distal arm moves outwardly and downwardly from the mast when the energy chain bracket assembly moves from the first configuration to the second configuration.

13. The drill rig of claim 1, wherein the first end of the energy chain is positioned on the first side of the mast along a transverse axis that is perpendicular to the longitudinal axis of the mast, wherein the drill rig further comprises a carriage that is movable relative to the mast along the longitudinal axis of the mast, wherein the drill head is pivotably coupled to the carriage about a pivot axis, wherein the second position of the drill head is pivotally offset from the first position about the pivot axis so that the drill head is closer to the first end of the energy chain when the drill head is in the second position than when the drill head is in the first position.

14. A method of using the drill rig as in claim 1, the method comprising:

moving the energy chain bracket assembly from the first configuration to the second configuration; and moving the drill head from the first position to the second position.

15. The method of claim 14, wherein the drill rig comprises a roller assembly coupled to the second end of the mast, wherein the roller assembly is configured to slew about a slewing axis that is parallel to the longitudinal axis of the mast, the method further comprising slewing the roller assembly about the slewing axis so that at least a portion of the roller assembly is in line with the drilling axis.

16. The method of claim 15, further comprising using a wireline assembly of the drill rig to pull an inner tube assembly from a borehole.

17. The method of claim 16, further comprising slewing the roller assembly away from the drilling axis.

18. The method of claim 17, further comprising:

moving the drill head from the second position to the first position; and moving the energy chain bracket assembly from the second configuration to the first configuration.

* * * * *